US011562686B1

(12) United States Patent
Lu

(10) Patent No.: US 11,562,686 B1
(45) Date of Patent: Jan. 24, 2023

(54) DISPLAY PANEL, LIGHT SENSING DETECTION METHOD THEREOF AND DISPLAY DEVICE

(71) Applicant: Shanghai Tianma Micro-Electronics Co., Ltd., Shanghai (CN)

(72) Inventor: Feng Lu, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 17/452,524

(22) Filed: Oct. 27, 2021

(30) Foreign Application Priority Data

Aug. 12, 2021 (CN) ..... 202110924710.3

(51) Int. Cl.
*G09G 3/32* (2016.01)

(52) U.S. Cl.
CPC ..... *G09G 3/32* (2013.01); *G09G 2300/0852* (2013.01); *G09G 2310/061* (2013.01); *G09G 2360/144* (2013.01); *G09G 2360/145* (2013.01)

(58) Field of Classification Search
CPC ..... G09G 3/32; G09G 3/3233; G09G 3/325; G09G 3/3258; G09G 2300/0852; G09G 2310/061; G09G 2360/144; G09G 2360/145
See application file for complete search history.

(56) References Cited

U.S. PATENT DOCUMENTS

| | | | | |
|---|---|---|---|---|
| 8,330,777 | B2 * | 12/2012 | Kim | G06F 3/0412 345/173 |
| 8,450,740 | B2 * | 5/2013 | Kim | G02F 1/13338 257/E31.085 |
| 8,922,526 | B2 * | 12/2014 | Wang | G06F 3/0428 345/175 |
| 9,741,290 | B1 * | 8/2017 | Lee | G09G 3/3233 |
| 11,372,302 | B2 * | 6/2022 | Wu | G02F 1/1368 |
| 2011/0084938 | A1 * | 4/2011 | Wang | G06F 3/0428 345/175 |
| 2022/0171225 | A1 * | 6/2022 | Wu | G02F 1/136222 |

FOREIGN PATENT DOCUMENTS

| | | |
|---|---|---|
| CN | 101256097 A | 9/2008 |
| CN | 101382453 A | 3/2009 |

* cited by examiner

*Primary Examiner* — Vijay Shankar
(74) *Attorney, Agent, or Firm* — Anova Law Group, PLLC

(57) ABSTRACT

Display panel, light sensing detection method thereof and display device are provided. The display panel includes a plurality of light sensing detection units. A light sensing detection unit of the plurality of light sensing detection units includes a light sensing detection circuit. The light sensing detection circuit corresponding to a same light sensing detection unit includes N light sensing detection branches connected in parallel, a light sensing detection branch of the N light sensing detection branches includes a storage capacitor, and N≥2. The N light sensing detection branches include a first light sensing detection branch and a second light sensing detection branch. The storage capacitor includes a first storage capacitor located in the first light sensing detection branch and a second storage capacitor located in the second light sensing detection branch. A capacitance of the first storage capacitor is greater than a capacitance of the second storage capacitor.

22 Claims, 14 Drawing Sheets

DISPLAY PANEL, LIGHT SENSING DETECTION METHOD THEREOF AND DISPLAY DEVICE

CROSS-REFERENCE TO RELATED APPLICATION

This application claims priority of Chinese Patent Application No.

202110924710.3, filed on Aug. 12, 2021, the entire contents of which are hereby incorporated by reference.

FIELD OF THE DISCLOSURE

The present disclosure generally relates to the field of display technology and, more particularly, relates to a display panel, a light sensing detection method thereof and a display device.

BACKGROUND

From a CRT (Cathode Ray Tube) era to an LCD era, to a now coming OLED (Organic Light-Emitting Diode) era, the display industry has experienced decades of development and has become rapidly changing. A display industry has been closely related to our lives. Devices from conventional mobile phones, tablets, TVs and PCs to electronic devices such as smart wearable devices and VRs are inseparable from display technology.

To meet people's needs, electronic devices can achieve more and more functions. An electronic device is generally provided with a light sensing detection unit for detections, such as optical fingerprint recognition or ambient light detection. In existing products, a sensitivity of the light sensing detection unit is fixed and can only be applied to scenes with a fixed light intensity environment, and an application range is limited.

BRIEF SUMMARY OF THE DISCLOSURE

One aspect of the present disclosure provides a display panel. The display panel includes a plurality of light sensing detection units. A light sensing detection unit of the plurality of light sensing detection units includes a light sensing detection circuit. The light sensing detection circuit corresponding to a same light sensing detection unit includes N light sensing detection branches connected in parallel, a light sensing detection branch of the N light sensing detection branches includes a storage capacitor, and N≥2. The N light sensing detection branches include a first light sensing detection branch and a second light sensing detection branch. The storage capacitor includes a first storage capacitor located in the first light sensing detection branch and a second storage capacitor located in the second light sensing detection branch. A capacitance of the first storage capacitor is greater than a capacitance of the second storage capacitor.

Another aspect of the present disclosure provides a light sensing detection method of a display panel. The display panel includes a plurality of light sensing detection units. A light sensing detection unit of the plurality of light sensing detection units includes a light sensing detection circuit. The light sensing detection circuit corresponding to a same light sensing detection unit includes N light sensing detection branches connected in parallel, a light sensing detection branch of the N light sensing detection branches includes a storage capacitor, and N≥2. The N light sensing detection branches include a first light sensing detection branch and a second light sensing detection branch. The storage capacitor includes a first storage capacitor located in the first light sensing detection branch and a second storage capacitor located in the second light sensing detection branch. A capacitance of the first storage capacitor is greater than a capacitance of the second storage capacitor. The light sensing detection method includes selectively turning on at least one of the first light sensing detection branch and the second light sensing detection branch in a light sensing detection stage and performing a light sensing detection by using at least one of the first light sensing detection branch and the second light sensing detection branch.

Another aspect of the present disclosure provides a display device including a display panel. The display panel includes a plurality of light sensing detection units. A light sensing detection unit of the plurality of light sensing detection units includes a light sensing detection circuit. The light sensing detection circuit corresponding to a same light sensing detection unit includes N light sensing detection branches connected in parallel, a light sensing detection branch of the N light sensing detection branches includes a storage capacitor, and N≥2. The N light sensing detection branches include a first light sensing detection branch and a second light sensing detection branch. The storage capacitor includes a first storage capacitor located in the first light sensing detection branch and a second storage capacitor located in the second light sensing detection branch. A capacitance of the first storage capacitor is greater than a capacitance of the second storage capacitor.

As disclosed, the display panel, the light sensing detection method thereof and the display device provided by the present disclosure have the following beneficial effects.

In the display panel, the light sensing detection method thereof and the display device, the light sensing detection branch corresponding to a same light sensing detection unit includes at least two light sensing detection branches connected in parallel. Different light sensing detection branches correspond to different storage capacitors. The smaller a capacitance of a storage capacitor, the higher a sensitivity of a light sensing detection unit. The larger a capacitance of the storage capacitor, the larger a dynamic detection range. Under a weak ambient light intensity, only a light sensing detection branch corresponding to a storage capacitor with a small capacitance, such as the second light sensing detection branch where the second storage capacitor is located, can be turned on so that the light sensing detection unit has a better sensitivity. Under a strong ambient light intensity, the light sensing detection branch where the storage capacitor is located with a large capacitance, such as the first light sensing detection branch where the first storage capacitor is located, can be turned on to realize a light sensing detection function under a strong ambient light intensity. Therefore, under a weak ambient light intensity, a high sensitivity requirement of the light-sensitive detection unit is guaranteed, under a strong ambient light intensity, the detection range requirement of the light-sensitive detection unit is guaranteed. As both the sensitivity requirement and the detection range requirement of the light sensing detection unit are considered, the light sensing detection unit has a wide application range and is more conducive to improving a user experience.

BRIEF DESCRIPTION OF THE DRAWINGS

Accompanying drawings incorporated in the specification and constituting part of the specification illustrate embodiments of the present disclosure, and together with a description of the embodiments are used to explain principles of the present disclosure.

DETAILED DESCRIPTION

Figure 1:
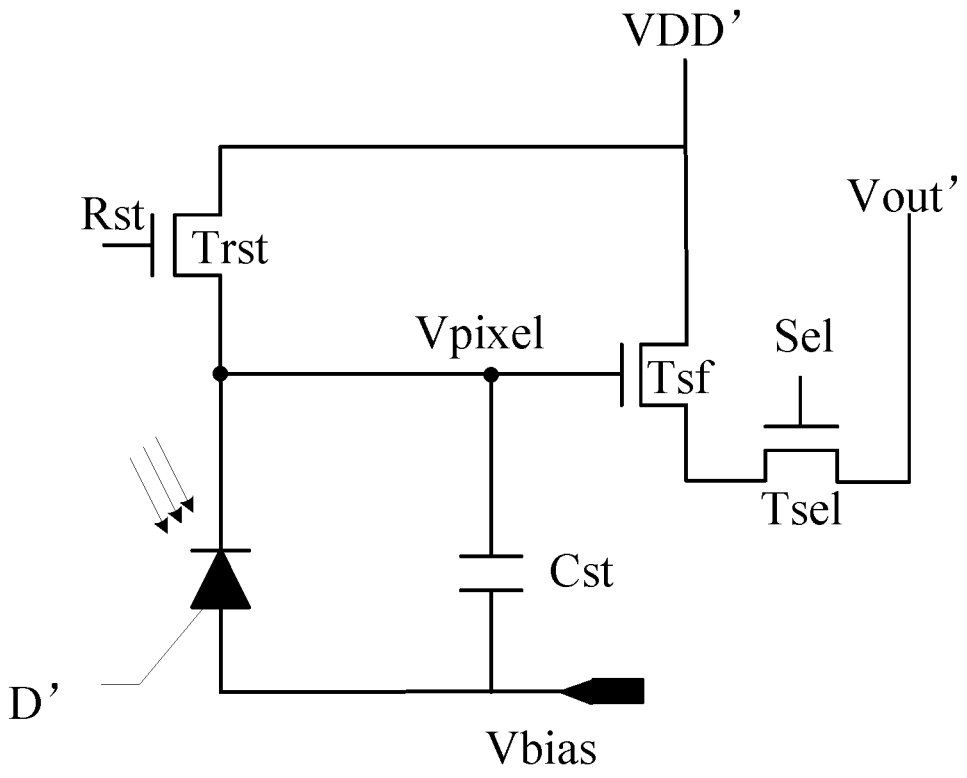
FIG. 1 illustrates a circuit diagram of a light sensing detection circuit corresponding to a light sensing detection unit.

Various exemplary embodiments of the present disclosure will now be described in detail with reference to the accompanying drawings. Unless specifically stated otherwise, relative arrangements of components and steps, numerical expressions and numerical values set forth in the embodiments do not limit a scope of the present disclosure.

A following description of at least one exemplary embodiment is only illustrative, and in no way serves as any limitation to the present disclosure and an application or use thereof.

Technologies, methods, and devices known to those skilled in the art may not be discussed in detail, but where appropriate, the technologies, methods, and devices should be regarded as part of the specification.

In all examples shown and discussed herein, any specific value should be interpreted as merely exemplary, rather than as a limitation. Therefore, other examples of the exemplary embodiments may have different values.

Similar reference numerals and letters indicate similar items in the following accompanying drawings, so once an item is defined in one accompanying drawing, the item does not need to be discussed further in subsequent accompanying drawings.

FIG. 1 illustrates a circuit diagram of a light sensing detection circuit corresponding to a light sensing detection unit. The light sensing detection circuit includes three transistors (respectively transistor Trst, transistor Tsf, and transistor Tsel), a photoelectric sensor D' and a storage capacitor Cst. The light sensing detection circuit also includes a reset scan line Rst, a fixed voltage signal line VDD', a selection scan line Sel, a voltage signal output line Vout'. If the light sensing detection circuit in FIG. 1 is a fingerprint recognition circuit, when a fingerprint recognition is performed, the fingerprint recognition circuit includes a reset stage, an exposure stage, and an electrical signal output stage.

In the reset stage, the transistor Trst is turned on in response to a control signal of the reset scan line Rst to reset the fingerprint recognition circuit. A reset voltage signal of the fixed voltage signal line VDD' is transmitted to a gate of the transistor Tsf through the transistor Trst. The voltage signal Vpixel at the gate of the transistor Tsf rises to an input voltage value of the first voltage signal line VDD', and the transistor Tsf is turned on.

In the exposure stage, a finger touches a screen. A light source reflects when the light source hits a valley line and a ridge line of a fingerprint. Since reflection angles of the valley line and the ridge line are different and light intensities of the reflected lights on the valley line and the ridge line are different, when the light is projected onto the photoelectric sensor D', a resistance of the photoelectric sensor D' changes, thereby generating charges, and forming a photocurrent. Due to a leakage current, the voltage signal Vpixel at the gate of the transistor Tsf starts to drop.

In the electrical signal output stage, due to different reflection angles of the valley line and the ridge line of the fingerprint and different intensities of the reflected light in the exposure stage, generated photocurrents are different, resulting in different change values of the voltage signals Vpixel. Therefore, fingerprint signals detected by the voltage signal output line Vout' are also different, and a fingerprint recognition function is realized by detecting a voltage signal of the voltage signal output line Vout'.

A sensitivity of the above light sensing detection circuit is fixed and can only be applied to the scene of a fixed light intensity. The sensitivity of the light sensing detection circuit is reflected in a voltage difference ΔVQ before and after the light. The voltage difference ΔVQ is related to an area $S_{pin}$ of the photoelectric sensor. A specific relationship is $\Delta VQ=S_{pin}/(S_{pin}+\sigma)$, an σ is an equivalent influence of an area corresponding to a stray capacitance. The area $S_{pin}$ of the photoelectric sensor is much larger than σ. Therefore, even if different photoelectric sensors are used, a change ratio of the voltage difference ΔVQ before and after light remains basically unchanged. Therefore, the sensitivity of the light sensing detection circuit will not be improved by replacing the photoelectric sensor. How to make the light sensing detection circuit have both high sensitivity and a plurality of detection ranges has become one of technical problems to be solved urgently.

The present disclosure provides at least two light sensing detection branches, and different light sensing detection branches are equipped with different storage capacitors to meet detection requirements under different light intensity environments, and to consider needs of high sensitivity and a plurality of detection ranges, thereby having a wide range of applications.

The following will be described in detail with reference to the accompanying drawings and specific embodiments.

Figure 2:
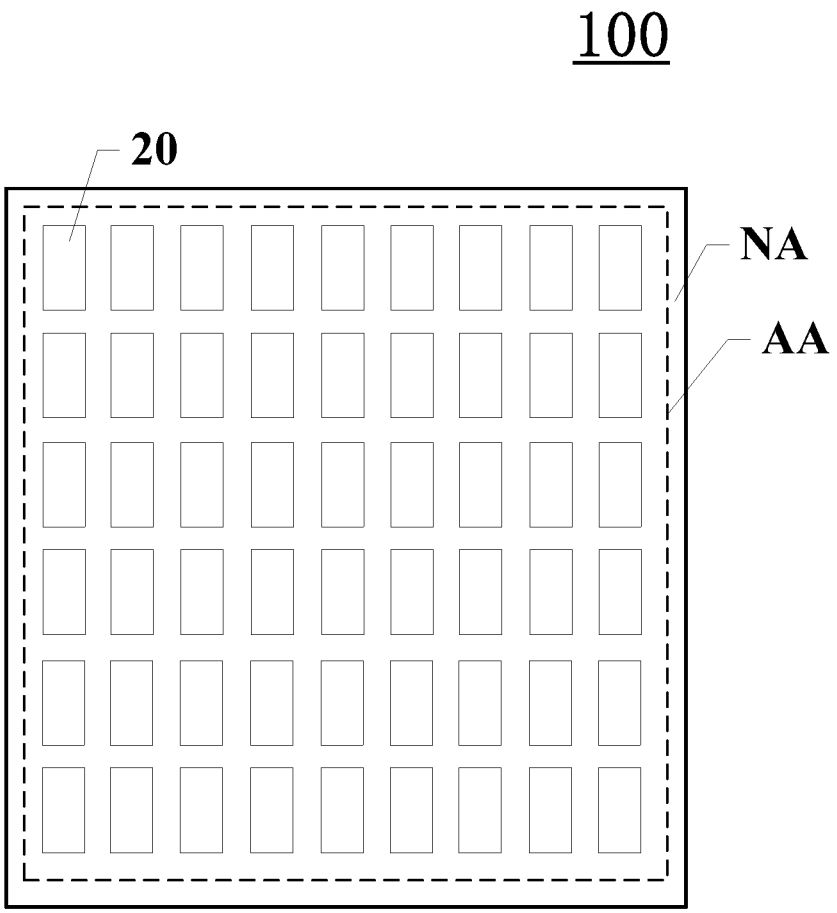
FIG. 2 illustrates a plane structure diagram of a display panel consistent with various embodiments of the present disclosure.
Figure 3:
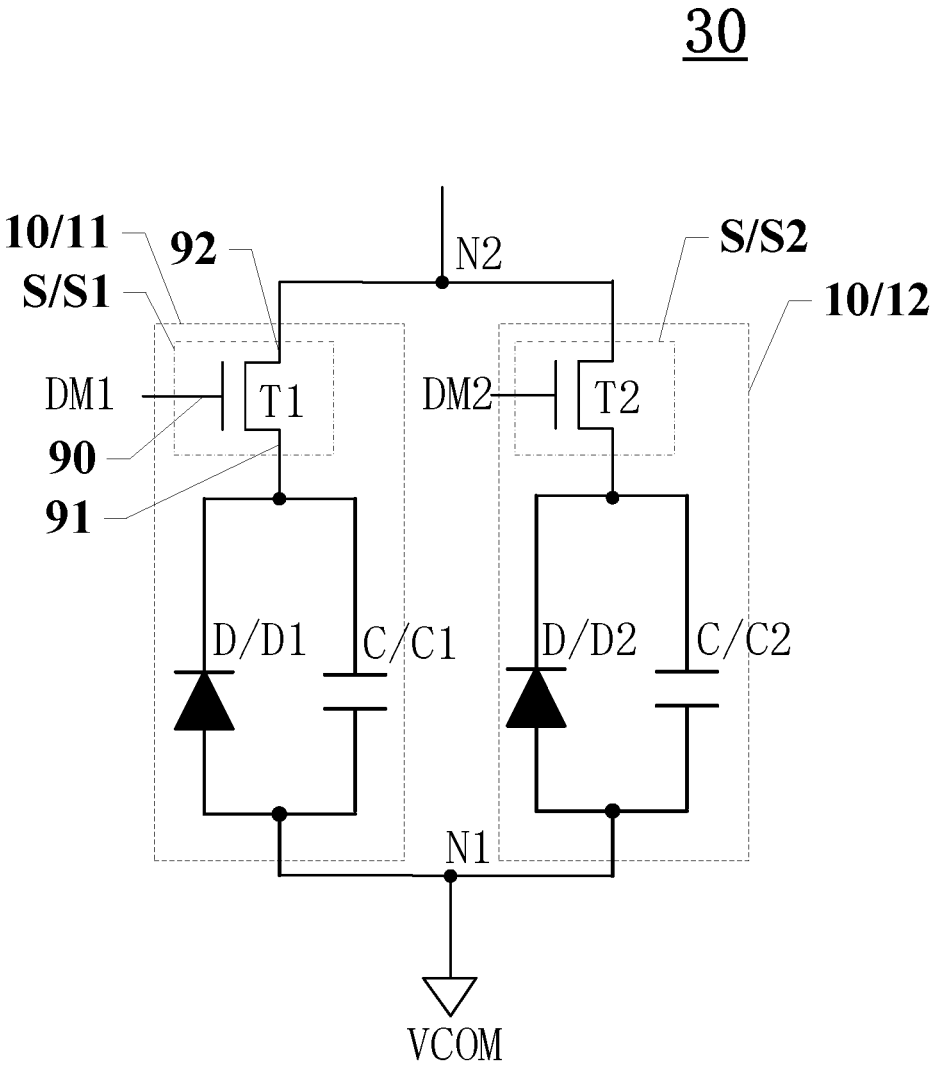
FIG. 3 illustrates a schematic diagram of a light sensing detection circuit in a display panel consistent with various embodiments of the present disclosure.

FIG. 2 illustrates a plane structure diagram of a display panel consistent with various embodiments of the present disclosure. FIG. 3 illustrates a schematic diagram of a light sensing detection circuit in a display panel consistent with various embodiments of the present disclosure. Referring to FIG. 2 and FIG. 3, a display panel 100 provided in one embodiment includes a plurality of light sensing detection units 20. a light sensing detection unit 20 of the plurality of light sensing detection units 20 includes a light sensing detection circuit 30.

The light sensing detection circuit 30 corresponding to a same light sensing detection unit 20 includes N light sensing detection branches 10 connected in parallel, a light sensing detection branch of the N light sensing detection branches includes a storage capacitor C, and N≥2. The N light sensing detection branches 10 include a first light sensing detection branch 11 and a second light sensing detection branch 12. The storage capacitors C includes a first storage capacitor C1 located in the first light sensing detection branch 11 and a second storage capacitor C2 located in the second light sensing detection branch 12. A capacitance of the first storage capacitor C1 is greater than a capacitance of the second storage capacitor C2.

FIG. 2 illustrates the display panel 100 by only taking the display panel 100 of a rectangular structure as an example. In some other embodiments, the display panel 100 may also be a rounded rectangle, a circle, an oval, or other special-shaped structures with arc-shaped edges, which is not specifically limited herein. The display panel 100 shown in FIG. 2 includes a display area AA and a non-display area NA, and the light sensing detection units 20 are distributed in the display area AA. In some other embodiments, the plurality of light sensing detection units 20 may also be in the non-display area NA. The plurality of light sensing detection units 20 can also be distributed only in part of the display area AA, which is not specifically limited herein. In addition, FIG. 2 only illustrates the plurality of light sensing detection units 20 and does not represent an actual shape and an actual quantity.

Optionally, the plurality of light sensing detection units 20 in the display panel 100 can be used as fingerprint recognition units to realize a fingerprint recognition function of the display panel 100. In some other embodiments, the plurality of light sensing detection unit 20 can also be used as ambient light detection units to realize an ambient light detection function.

Specifically, each light sensing detection unit 20 in the display panel 100 corresponds to a light sensing detection circuit 30 as shown in FIG. 3. Each light sensing detection circuit 30 includes at least two light sensing detection branches 10 connected in parallel, and each light sensing detection branch 10 includes a storage capacitor C. FIG. 3 takes a light sensing detection circuit 30 includes two light sensing detection branches 10 as an example for illustration. The two light sensing detection branches 10 are respectively embodied as the first light sensing detection branch 11 and the second light sensing detection branch 12. The first light sensing detection branch 11 includes a first storage capacitor C1. The second light sensing detection branch 12 includes a second storage capacitor C2. The capacitance of the first storage capacitor C1 is greater than the capacitance of the second storage capacitor C2.

A sensitivity of the light sensing detection circuit 30 is embodied as the voltage difference ΔVQ before and after the illumination. The voltage difference ΔVQ is also inversely related to a capacitance of a storage capacitor C. The smaller the capacitance of the storage capacitor C, the higher the sensitivity of the light sensing detection unit 20. The greater the capacitance of the storage capacitor C, the greater a detectable ambient light intensity. Under a weak ambient light intensity, only the light sensing detection branch 10 corresponding to a storage capacitor C with a smaller capacitance can be turned on. For example, the second light sensing detection branch 12 where the second storage capacitor C2 is located is turned on for light sensing detection. The light sensing detection circuit 30 has a better sensitivity. Under a strong ambient light intensity, the light sensing detection branch 10 where the storage capacitor C is located with a larger capacitance can be turned on. For example, the first light sensing detection branch 11 where the first storage capacitor C1 is located is turned on for light sensing detection, to realize a light sensing detection function under the condition of a strong ambient light intensity. Therefore, under the condition of a weak ambient light intensity, the storage capacitor C with a smaller capacitance ensures a high sensitivity requirement of the light sensing detection unit 20. Under the condition of a strong ambient light intensity, a storage capacitor C with a larger capacitance ensures a detection range requirement of the light sensing detection unit 20. Therefore, the light sensing detection circuit 30 considers both the high sensitivity and a plurality of detection ranges and has a wide application range.

When a same light sensing detection circuit 30 includes two light sensing detection branches 10, under different ambient light intensities, only one of the first light sensing detection branch 11 and the second light sensing detection branch 12 can be turned on. When only the second light sensing detection branch 12 is turned on, the light sensing detection circuit 30 is suitable for a strong ambient light environment. When only the second light sensing detection branch 12 is turned on, the light sensing detection circuit 30 is suitable for a weak ambient light environment with a high sensitivity. Optionally, the first light-sensitive detection branch 11 and the second light-sensitive detection branch 12 can be turned on at a same time. An overall sensitivity of the light sensing detection circuit 30 is between a sensitivity when only the first light sensing detection branch 11 is turned on and a sensitivity when only the second light sensing detection branch 12 is turned on. An ambient light intensity of the light sensing detection circuit 30 that can be sensed is also between an ambient light intensity when only the first light sensing detection branch 11 is turned on and an ambient light intensity when only the second light sensing detection branch 12 is turned on. Therefore, although only two light sensing detection branches 10 are introduced, a switching of three kinds of sensitivity and three kinds of ambient light intensity is realized, so that the display panel has a wide application range.

Figure 4:
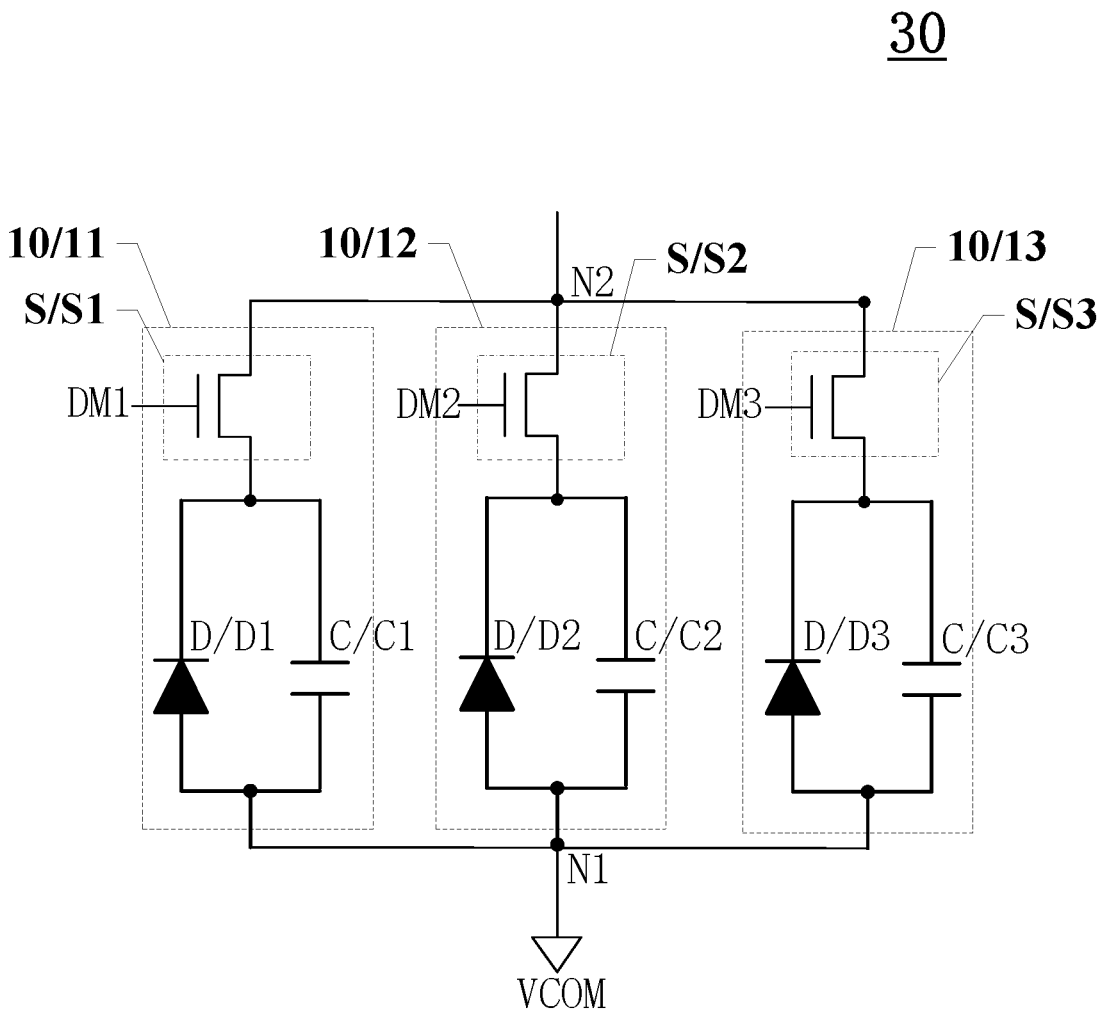
FIG. 4 illustrates another schematic diagram of a light sensing detection circuit in a display panel consistent with various embodiments of the present disclosure.

In some other embodiments, number of light sensing detection branches 10 included in a same light sensing detection circuit 30 can also be three or more. Actual number of light sensing detection branches 10 included in a same light sensing detection circuit 30 can be determined according to actual needs. FIG. 4 illustrates another schematic diagram of a light sensing detection circuit in a display panel consistent with various embodiments of the present disclosure. FIG. 4 shows one embodiment in which a same light sensing detection circuit 30 includes three light sensing detection branches 10. In addition to the first light sensing detection branch 11 and the second light sensing detection branch 12, the light sensing detection circuit 30 also includes a third light sensing detection branch 13. The third light sensing detection branch 13 includes a third storage capacitor C3. Optionally, a capacitance of the third storage capacitor C3 is greater than the capacitance of the first storage capacitor C1. That is, it is necessary to ensure that capacitances of the storage capacitors C in a plurality of light sensing detection branches 10 corresponding to a same light sensing detection circuit 30 are different. Therefore, through a parallel connection of the plurality of light sensing detection branches 10, a light sensing detection under more different ambient light intensities is realized, and an application range is wide.

In one optional embodiment, referring to FIG. 3, the light sensing detection circuit 30 also includes a first node N1 and a second node N2. In a same light sensing detection circuit 30, each light sensing detection branch 10 is connected in parallel between the first node N1 and the second node N2. The first node N1 receives the first fixed voltage signal VCOM.

Specially, referring to FIG. 3, in one embodiment, the plurality of light sensing detection branches 10 is connected in parallel between the first node N1 and the second node N2. An electric potential of the first node N1 is constant. When one or two light sensing detection branches 10 are used for light sensing detection, a light sensing signal can be transmitted to the second node N2 through the conductive light sensing detection branch 10, to achieve a light sensing detection under different ambient light intensities.

In one optional embodiment, referring to FIG. 3 and FIG. 4, the light sensing detection branches 10 also include switching circuits S and light sensing elements D respectively. A switching circuit S includes a control terminal 90, a first electrode 91 and a second electrode 92. In a same light sensing detection branch 10, a light sensing element D and a storage capacitor C are connected in parallel between the first node N1 and a first electrode 91 of a switching circuit S, and a second electrode 92 of the switching circuit S is connected to the second node N2. In a same light sensing detection circuit 30, the control terminals 90 of the switching circuits S of different light sensing detection branches 10 are connected to different switching signal terminals.

Specially, taking FIG. 4 as an example, a same light sensing detection circuit 30 includes three light sensing detection branches 10. Each light sensing detection branch 10 includes a light sensing element D connected in parallel with a storage capacitor C. Each light sensing detection branch 10 includes a switching circuit S. Specifically, the first light sensing detecting branch 11 includes a first switching circuit S1, the second light sensing detecting branch 12 includes a second switching circuit S2, and the third light sensing detection branch 13 includes a third switching circuit S3. In a same light sensing detection circuit 30, control terminals 90 of different switching circuits S are connected to different switching signal terminals. For example, a control terminal of the first switching circuit S1 is connected to a first switching signal terminal DM1, a control terminal of the second switching circuit S2 is connected to a second switching signal terminal DM2, and a control terminal of the third switching circuit S3 is connected to the third switching signal terminal DM3. Different switching circuits can be controlled separately through different gating signal terminals. For example, only one of the light sensing detection branches 10 can be controlled to be turned on, or two or three light sensing detection branches 10 can be controlled to be turned on at a same time, so that the turned-on light sensing detection branches 10 can perform light sensing detections under different ambient light intensities and achieve different sensitivity requirements at a same time.

In one optional embodiment, referring to FIG. 3, the switching circuit S includes switch transistors, and the switch transistors include a first switch transistor T1 located in the first light sensing detection branch 11 and a second switch transistor T2 located in the second light sensing detection branch 12. A width-to-length ratio of the first switch transistor T1 is greater than a width-to-length ratio of the second switch transistor T2.

Specially, referring to FIG. 3, in the first light sensing detection branch 11 and the second light sensing detection branch 12, a capacitance of the first storage capacitor C1 is greater than a capacitance of the second storage capacitor C2. The smaller a capacitance of a storage capacitor C is, the more susceptible the storage capacitor C is to an off-state leakage current of a switch transistor. In the present disclosure, setting the width-to-length ratio of the first switch transistor T1 to be greater than the width-to-length ratio of the second switch transistor T2 is beneficial to reduce an influence of an off-state leakage current of the second switch transistor T2 with a small width-to-length ratio on the second storage capacitor C2. Meanwhile, the smaller the capacitance of the storage capacitor C, the faster a charge and discharge rate of the corresponding light sensing element D. In a light sensing detection branch 10 with a small capacitance of the storage capacitor C provided in the present disclosure, a width-to-length ratio of the switch transistor is set to be relatively small, and in a light sensing detection branch 10 with a large storage capacitor C value, a width-to-length ratio of the switch transistor is set at a same time, which is beneficial to balance charge and discharge rates of the light sensing elements D in different light sensing detection branches 10, so that charge and discharge rates of different light sensing branches 10 corresponding to the same light sensing detection circuit 30 are similar.

The present disclosure introduces a separate switch transistor for each light sensing detection branch. The switch transistor controls a conduction of each light sensing detection branch. In existing technology, one implementation manner is to introduce a switch transistor between the storage capacitors and use the switch transistor to control whether the storage capacitors are connected in parallel. Although the above manner can also achieve different detection ranges, a difference between a threshold capacitance of the switch transistor and a capacitance of the switch transistor causes an uncertainty in an overall parallel capacitance after each switch, which may easily lead to problems such as calibration failures. Compared with a scheme in the embodiment where a switch transistor is separately provided for each light sensing detection branch, the above implementation manner of providing a switch transistor between the storage capacitors has a poor detection stability and affect a sensitivity of the light sensing detection circuit. Therefore, in the embodiment, a separate switch transistor is provided for each light sensing detection branch, the light sensing element is directly connected to the storage circuit, and there is no switch or transistor between the light sensing element and the storage circuit, thereby avoiding an influence of a switch on the light sensing detection, reducing an uncertainty of the light sensing detection circuit, and improving a detection stability and a sensitivity stability of the light sensing detection branches.

Figure 5:
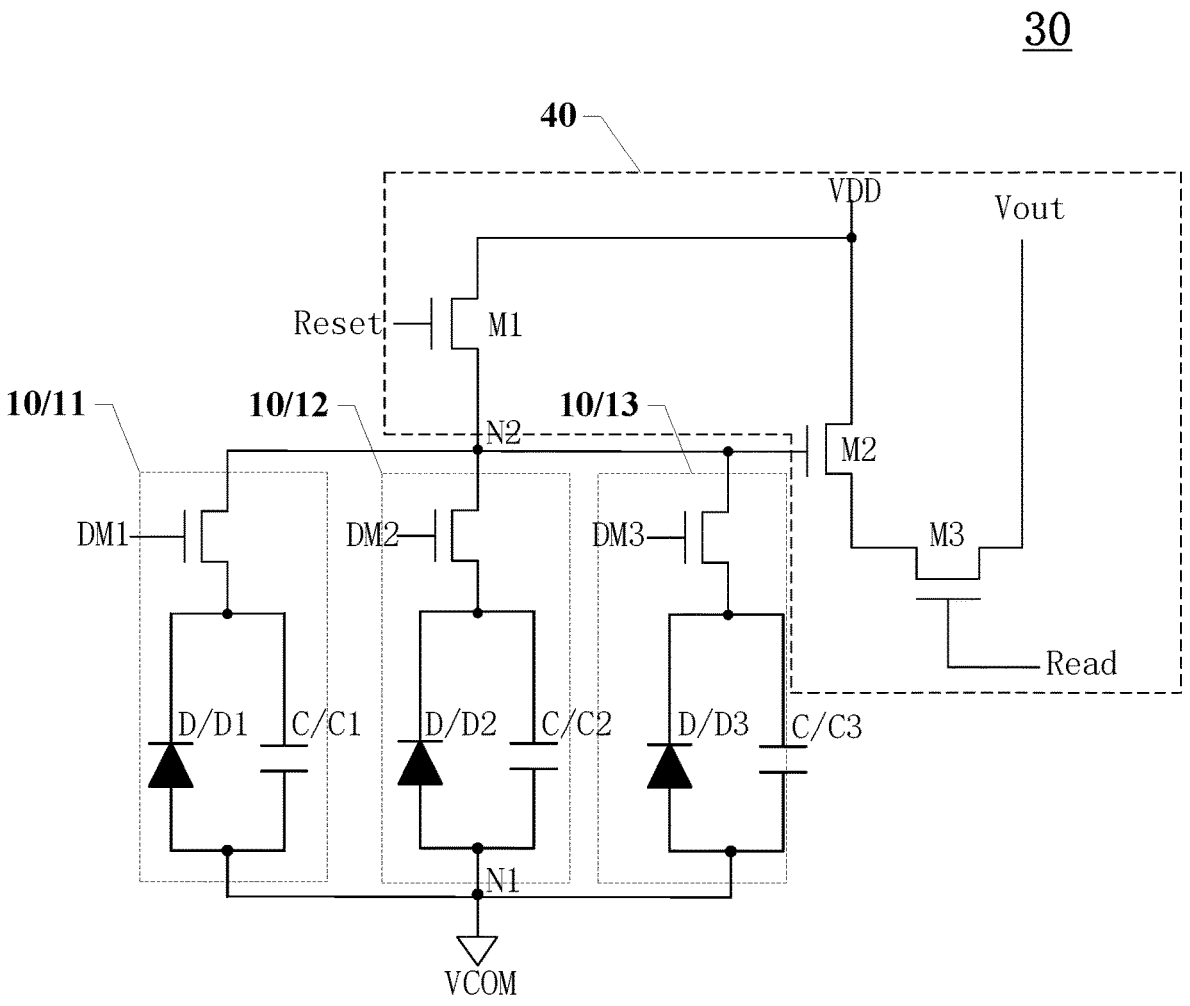
FIG. 5 illustrates another schematic diagram of a light sensing detection circuit in a display panel consistent with various embodiments of the present disclosure.

In one optional embodiment, FIG. 5 illustrates a schematic diagram of a light sensing detection circuit 30 in the display panel 100. The light sensing detection circuit 30 also includes a light sensing detection main circuit 40 connected to the second node N2.

The light sensing detection main circuit includes a first transistor M1, a second transistor M2 and a third transistor M3. A gate of the first transistor M1 is connected to a first control signal terminal Reset. A first electrode of the first transistor M1 and a gate of the second transistor M2 are connected to the second node N2. A second electrode of the first transistor M1 is connected to a first electrode of the second transistor M2 and receives the second fixed voltage signal VDD. A second electrode of the second transistor M2 is connected to a first electrode of the third transistor M3. A second electrode of the third transistor M3 serves as the output terminal Vout of the light sensing detection circuit 30. A gate of the third transistor M3 is connected to the second control signal terminal Read.

Referring to FIG. 5, the light sensing detection circuit 30 includes at least two light sensing detection branches 10 connected in parallel and a light sensing detection main circuit 40. The light sensing detection main circuit 40 is also connected to the second node N2. Therefore, a signal of the light sensing detection branch 10 can be transmitted to the light sensing detection main circuit 40 through the second node N2. Specifically, the light sensing detection main circuit 40 includes three transistors, namely the first transistor M1, the second transistor M2, and the third transistor M3. The first electrode of the first transistor M1 and the gate of the second transistor M2 are connected to the second node N2. In the reset stage, the first transistor M1 is turned on in response to a control signal of the first control signal terminal Reset. A signal of the second fixed voltage signal terminal VDD is transmitted to the gate of the second transistor M2 through the first transistor M1. A voltage of the second node N2 rises to a voltage corresponding to the second fixed voltage signal terminal VDD to turn on the second transistor M2. In the exposure stage, a finger touches a screen. A light source reflects when the light source hits a valley line and a ridge line of a fingerprint. Since light intensities of the reflected light on the valley line and the ridge line are different, when the light is projected onto the light sensing element D, a resistance of light sensing element D changes, thereby generating charges, and forming a photocurrent. Due to a leakage current, a voltage of the second node N2 starts to drop. Because the light intensities of the reflected light on the valley line and the ridge line of the fingerprint are different, generated photocurrents are different, resulting in different change values of the second node N2, Fingerprint signals output by the output terminal Vout of the light sensing detection circuit 30 are also different. A fingerprint recognition function can be realized by detecting voltage signals output by the output terminal Vout.

Figure 6:
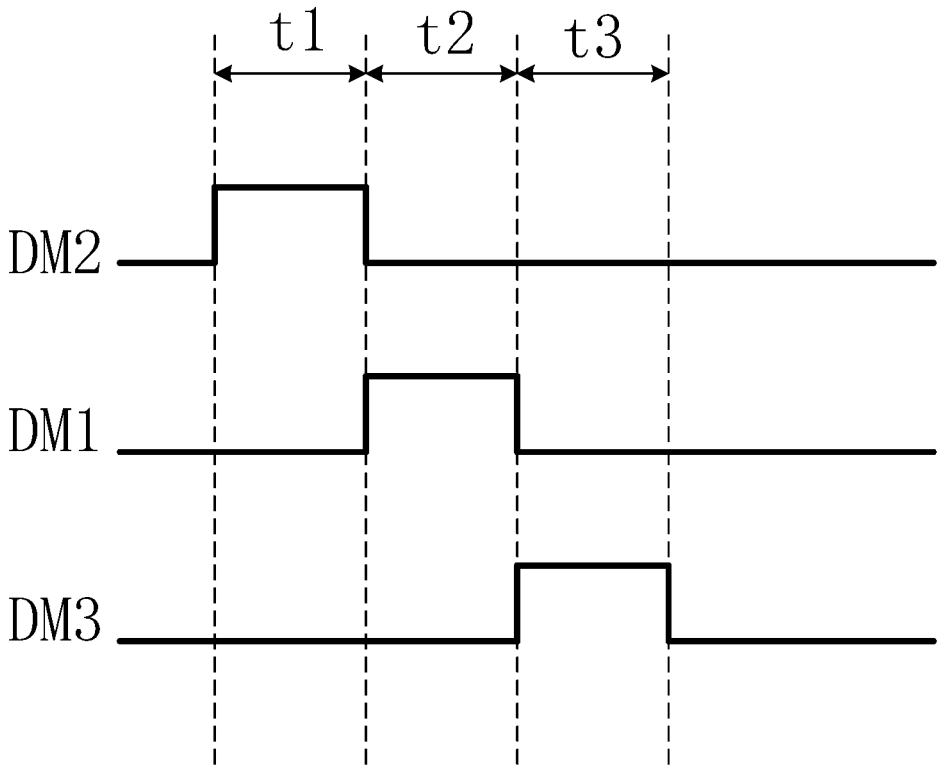
FIG. 6 illustrates a working timing diagram of the light sensing detection circuit in FIG. 5.

For the light sensing detection circuit 30 shown in FIG. 5, in an actual application process, different light sensing detection branches 10 can be selectively turned on according to aa ambient light intensity. Assuming that the capacitance of the third storage capacitor C3 is greater than the capacitance of the first storage capacitor C1, and the capacitance of the first storage capacitor C1 is greater than the capacitance of the second storage capacitor C2, the second light sensing detection branch 12 corresponding to the second storage capacitor has a highest sensitivity, and a light sensing detection branch 10 corresponding to the third storage capacitor C3 can detect a maximum ambient light intensity. FIG. 6 illustrates a working timing diagram of the light sensing detection branches 10 in FIG. 5 corresponding to three different ambient light intensities respectively. An ambient light intensity in a t1 stage is the weakest, an ambient light intensity in a t2 stage is stronger, and an ambient light intensity in a t3 stage is the strongest. Referring to FIG. 5 and FIG. 6, in the t1 stage, the switch transistor corresponding to the second light sensing detection branch 12 is turned on in response to a signal of the switching signal terminal DM2, the second light sensing detection branch 12 performs light sensing detection and a corresponding sensitivity is highest. In the t2 stage, the switch transistor corresponding to the first light sensing detection branch 11 is turned on in response to a signal of the switching signal terminal DM1, and the first light sensing detection branch 11 performs light sensing detection. In the t3 stage, the switch transistor corresponding to the third light sensing detection branch 13 is turned on in response to a signal of the switching signal terminal DM3, and the third light sensing detection branch 13 performs light sensing detection. Therefore, under different ambient light intensities, different light sensing detection branches 10 are selected for light sensing detection, which is beneficial to ensure a sensitivity of the circuit under a weak light intensity and can also realize a light sensing detection under a strong light intensity at a same time.

The timing diagram shown in FIG. 6 only shows a situation where only one light sensing branch is turned on in a same stage. In some other embodiments, number of light sensing detection branches that are turned on at a same stage can also be set according to actual needs. For example, two or more light sensing detection branches can be turned on at a same stage, so that the light sensing detection circuit has more light intensity detection ranges and more sensitivity ranges.

Figure 7:
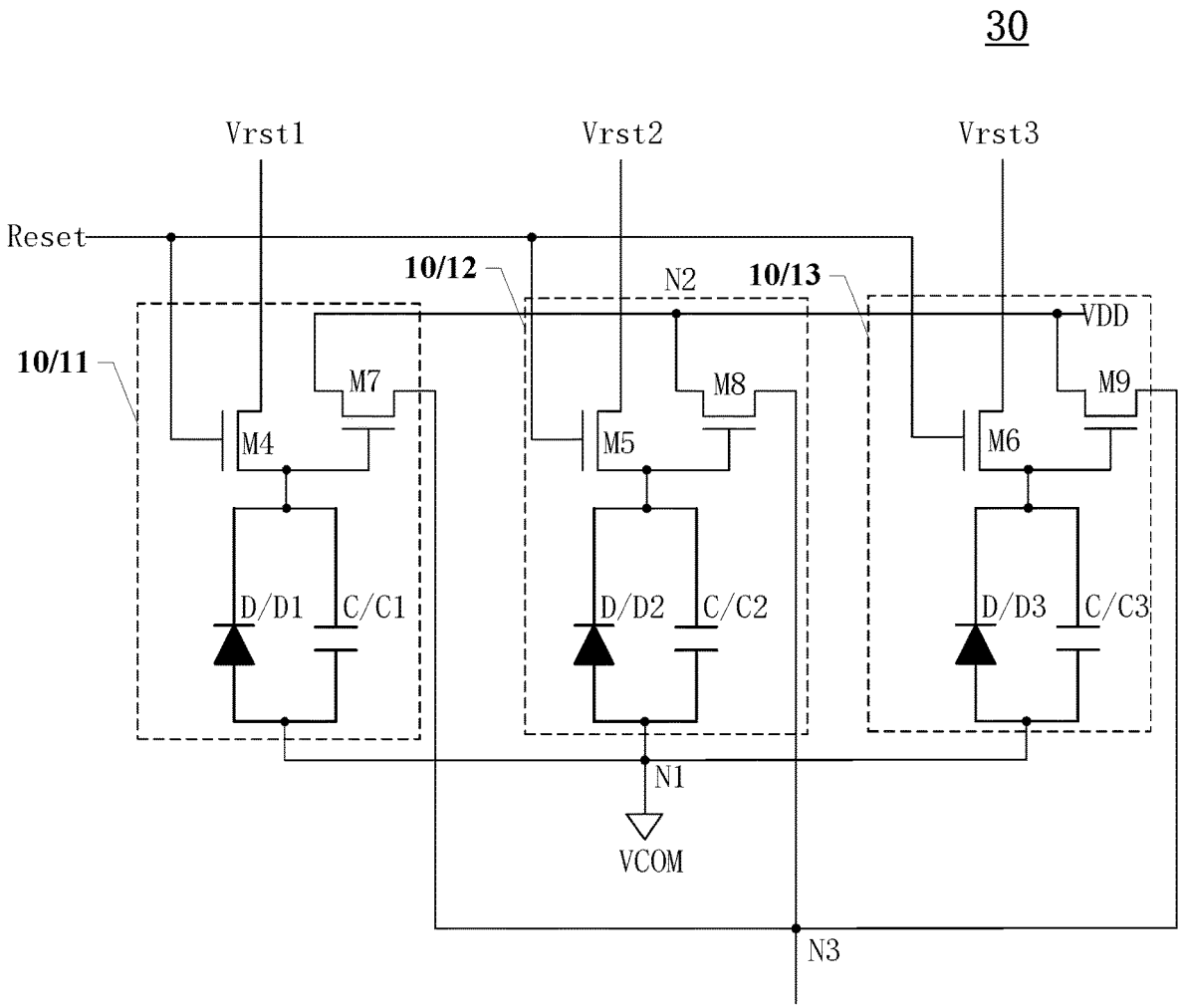
FIG. 7 illustrates another schematic diagram of a light sensing detection circuit in a display panel consistent with various embodiments of the present disclosure.

FIG. 7 illustrates another schematic diagram of the light sensing detection circuit 30 in the display panel consistent with various embodiments of the present disclosure. Referring to FIG. 7, in one optional embodiment, the light sensing detection circuit 30 also includes a third node N3. The light sensing detection branches 10 also respectively includes a reset transistor (corresponding to transistor M4, M5, and or M6), a drive transistor (corresponding to transistor M7, M8, or M9), and a light sensing element (corresponding to light sensing element D1, D2, or D3). In a same light sensing detection branch 10, the light sensing element D and the storage capacitor C are connected in parallel between the first node N1 and a first electrode of the reset transistor. A first electrode of the reset transistor is also electrically connected to a gate of the drive transistor. A first electrode of the drive transistor is connected to the second node N2. A second electrode of the drive transistor is connected to the third node N3. The second node N2 receives the second fixed voltage signal VDD.

In a same light sensing detection circuit 30, a gate of the reset transistor in each light sensing detection branch 10 is connected to a same first control signal terminal Reset. A second electrode of the reset transistor in each light sensing detection branch 10 is connected to a different reset signal terminal (Vrst1, Vrst2 and Vrst3 respectively).

Referring to FIG. 7, one embodiment illustrates another possible structure of the light sensing detection circuit 30. In the embodiment, a same light sensing detection circuit 30 including three light sensing detection branches 10 is taken as an example. In some other embodiments, number of light sensing detection branches 10 in the embodiment shown in FIG. 7 may also be two or more than three, which is not specifically limited herein. Each light sensing detection branch 10 includes a reset transistor (M4, M5, or M6), a drive transistor (M7, M8, or M9), a light sensing element (D1, D2, or D3), and a storage capacitor (C1, C2, or C3). A light sensing element D and a storage capacitors C are connected in parallel between the first node N1 and the first electrode of the reset transistor, and gates of all reset transistors are connected to a same first control signal terminal Reset. In the reset stage, a reset transistor in each light sensing detection branch 10 respectively receives a control signal sent by the first control signal terminal. Second electrodes of reset transistor in each light sensing detection branch 10 are respectively connected to different reset signal terminals (Vrst1, Vrst2, Vrst3), and are used to be turned on in response to signals from reset signal terminals. Taking the first light sensing detection branch 11 as an example, when the first reset transistor M4 is turned on, a signal of the first reset signal terminal Vrst1 will be transmitted to a gate of the first drive transistor M7 through the reset transistor M4, so that the first drive transistor M7 is turned on. In the exposure stage, a light source reflects when the light source hits a valley line and a ridge line of a fingerprint. Since reflection angles of the valley line and the ridge line are different and light intensities of the reflected lights on the valley line and the ridge line are different, when the light is projected onto the first light sensing element D1, a resistance of the first light sensing element D1 changes, thereby generating charges, and forming a photocurrent. Due to a leakage current, a potential of the gate of the first drive transistor M7 drops. Due to different reflection angles of the valley line and the ridge line of the fingerprint and different light intensities of the reflected lights during the exposure stage, the generated photocurrents are different, resulting in different change values of the voltage outputs from the first drive transistor M7 to the third node N3, thereby realizing a fingerprint recognition function.

Figure 8:
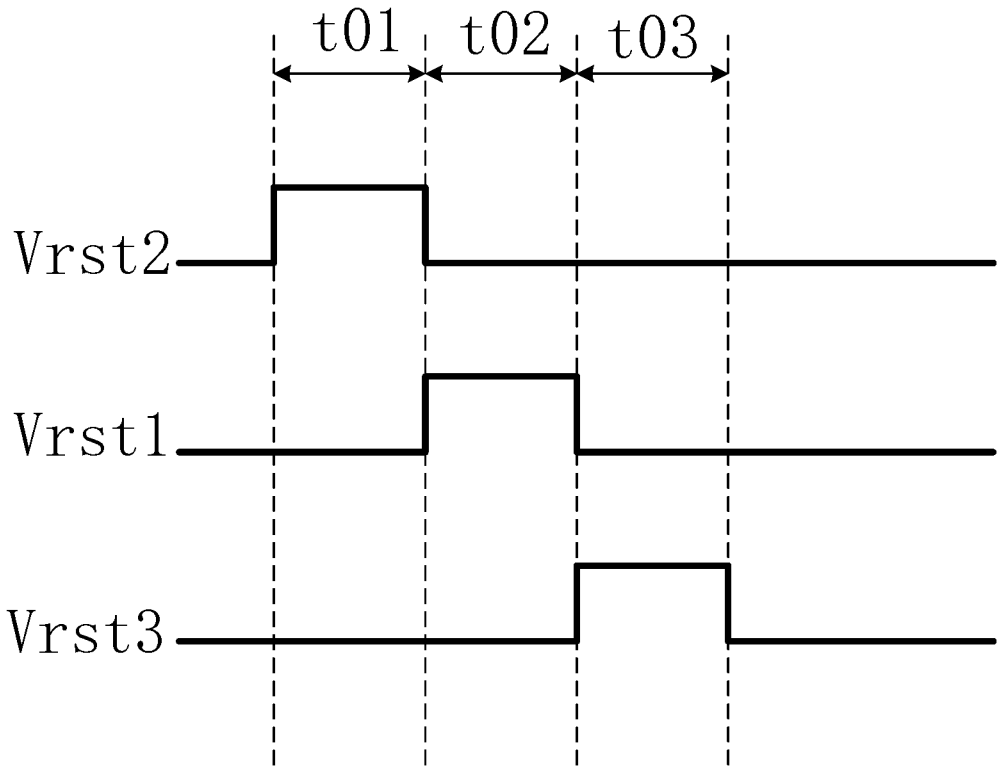
FIG. 8 illustrates a working timing diagram of the light sensing detection circuit in FIG. 7.

FIG. 8 illustrates a working timing diagram of the light sensing detection circuit 30 in FIG. 7 corresponding to three different ambient light intensities respectively. An ambient light intensity in a t01 stage is the weakest, an ambient light intensity in a t02 stage is stronger, and an ambient light intensity in a t03 stage is the strongest. In the t01 stage, a second reset signal terminal Vrst2 sends a high-level signal to the second reset transistor M5, so that the second drive transistor M8 is turned on, and the second light sensing detection branch 12 is used for light sensing detection. Since the capacitance of the second storage capacitor C2 in the second light sensing detection branch 12 is the smallest, the sensitivity of the light sensing detection circuit 30 is highest. In the t02 stage, the first reset signal terminal Vrst1 sends a high-level signal to the first reset transistor M4, so that the first drive transistor M7 is turned on and the first light sensing detection branch 11 is used for light sensing detection. Since the capacitance of the first capacitor in the first light sensing detection branch 11 is greater than the capacitance of the second capacitor in the second light sensing detection branch 12, when the second light sensing detection branch 12 is used for detection, a corresponding light intensity range is wide. In the t03 stage, the third reset signal terminal Vrst3 sends a high-level signal to the third reset transistor M6, so that the third drive transistor M9 is turned on, and the third light sensing detection branch 13 is used for light sensing detection. Since the third storage capacitor C3 corresponding to the third light sensing detection branch 13 has the largest capacitance, the third light sensing detection branch 13 has a stronger light intensity detection range and a wider application range. Therefore, under different ambient light intensities, different light sensing detection branches 10 are selected for light sensing detection, which is beneficial to ensure a sensitivity of the circuit under a weak light intensity, and to realize a light sensing detection under a strong light intensity at a same time.

The timing diagram shown in FIG. 8 only shows a situation where only one light sensing detection branch is turned on in a same stage. In some other embodiments, number of light sensing detection branches that are turned on at a same stage can also be set according to actual needs. For example, two or more light sensing detection branches can be turned on in a same stage, so that the light sensing detection circuit has more light intensity detection ranges and more sensitivity range.

Figure 9:
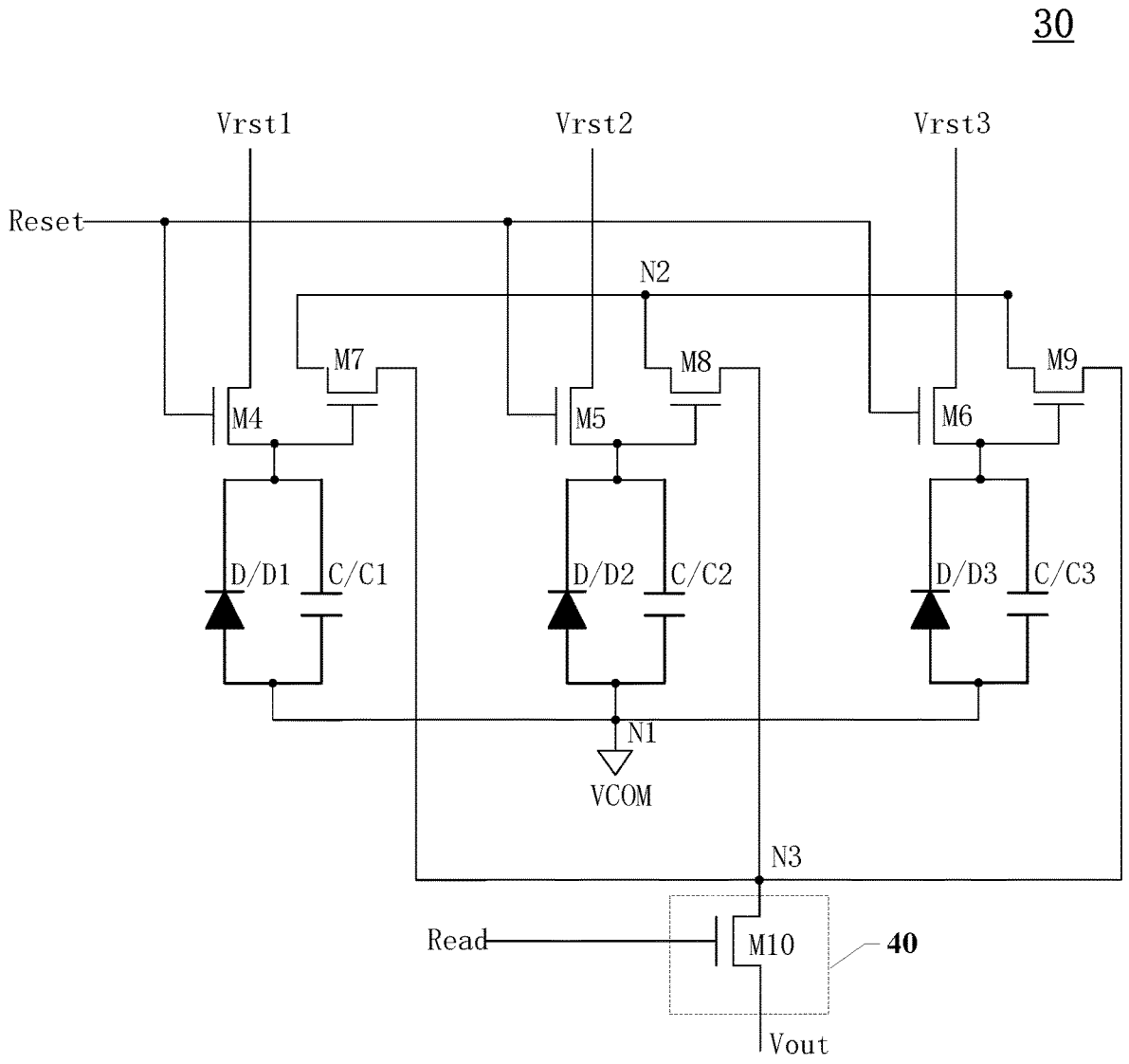
FIG. 9 illustrates another schematic diagram of a light sensing detection circuit in a display panel consistent with various embodiments of the present disclosure.

FIG. 9 illustrate another schematic diagram of the light sensing detection circuit 30 in a display panel 0 consistent with various embodiments of the present disclosure. Referring to FIG. 9, in one optional embodiment, the light sensing detection circuit 30 also includes a light sensing detection main circuit 40, which includes an output transistor M10. A gate of the output transistor M10 is connected to the second control signal terminal Read, a first electrode of the light sensing detection main circuit 40 is connected to the third node N3, and a second electrode of the light sensing detection main circuit 40 serves as the output terminal Vout of the light sensing detection circuit 30.

Specially, referring to FIG. 9, the light sensing detection circuit 30 further includes a light sensing detection main circuit 40 electrically connected to the third node N3. When the output transistor M10 in the light sensing main circuit 40 is turned on, a light sensing detection signal can be transmitted to the output terminal of the light sensing circuit 30 through the third node N3 and the output transistor M10, thereby realizing a light sensing detection function.

Figure 10:
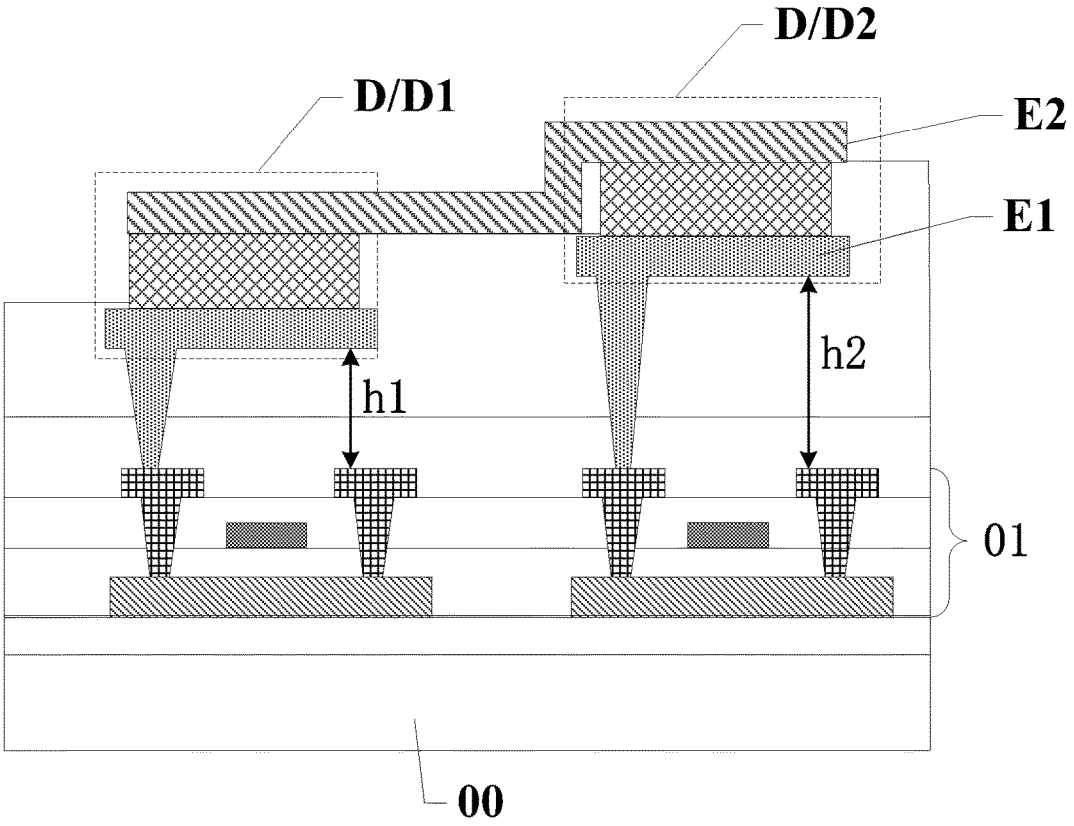
FIG. 10 illustrates a film structure diagram of a display panel consistent with various embodiments of the present disclosure.

FIG. 10 illustrates a film structure diagram of a display panel 100 consistent with various embodiments of the present disclosure. In one optional embodiment, the display panel 100 includes a substrate 00, an array layer 01 and light sensing elements D. Along a direction perpendicular to the substrate 00, the light sensing elements D are located on a side of the array layer 01 away from the substrate 00. A light sensing element D includes a first electrode E1 and a second electrode E2 arranged opposite to each other in a direction perpendicular to the substrate 00. The first electrode E1 is located on a side of the second electrode E2 facing the substrate 00. Referring to FIG. 3 and FIG. 10, the light sensing elements D include a first light sensing element D1 located in the first light detection branch 11 and a second light sensing element D2 located in the second light detection branch 12.

Referring to FIG. 3 and FIG. 10, FIG. 10 only illustrates a stacking relationship diagram of the light sensing elements D and the array layer 01 in a same light sensing detection circuit 30 on the substrate 00. A same light sensing detection circuit 30 including two light sensing elements D is taken as an example for description. The two light sensing elements D shown in FIG. 10 are respectively located in different light sensing detection branches 10. The first electrode E1 of the first light sensing element D1 and the first electrode E1 of the second light sensing element D2 are respectively connected to different transistors. The second electrode E2 of the first light sensing element D1 and the second electrode E2 of the second light sensing element D2 may have a same potential. For example, the second electrodes E2 of different light sensing elements D can be connected, or the second electrodes E2 of different light sensing elements D share a same planar electrode. Optionally, structures and sizes of different light sensing elements D in a same light sensing detection circuit 30 can be completely same to simplify a manufacturing process of the display panel 100.

Optionally, the light sensing element D mentioned in one embodiment is a PIN photodiode. A specific structure of the light sensing element D is to add a low-doped intrinsic semiconductor layer between a P-type semiconductor material layer and a N-type semiconductor material layer. The P-type semiconductor material layer can be used as the first electrode E1 of the light sensing element D in the present disclosure, and the N-type semiconductor material layer can be used as the second electrode E2 of the light sensing element D in the present disclosure. Or the P-type semiconductor layer is used as the second electrode E2 of the light sensing element D in the present disclosure, and the N-type semiconductor material layer is used as the first electrode E1 of the light sensing element D in the present disclosure.

In one optional embodiment, referring to FIG. 3 and FIG. 10, in a same light sensing detection circuit 30, a distance between the first electrode E1 of the first light sensing element D1 and the array layer 01 is h1, a distance between the first electrode E1 of the second light sensing element D2 and the array layer 01 is h2, and h1<h2. Optionally, the array layer 01 is provided with a plurality of transistors. Gates, sources, and drains of the plurality of transistors are conductive structures. The smaller a distance between the light sensing elements D and the array layer 01, the greater a voltage between the light sensing elements D and conductive structures in the array layer 01. Therefore, the present disclosure sets the distance h1 between the first electrode E1 of the first light sensing element D1 and the array layer 01 to be smaller than the distance h2 between the first electrode E1 of the second light sensing element D2 and the array layer 01, so that the capacitance of the first storage capacitor C1 corresponding to the first light sensing detection branch 11 is greater than the capacitance of the second storage capacitor C2 corresponding to the second light sensing detection branch 12. Therefore, the first light sensing detection branch 11 has a light sensing detection capability under a large ambient light intensity, and the second light sensing detection branch 12 has a good detection sensitivity at a same time.

Figure 11:
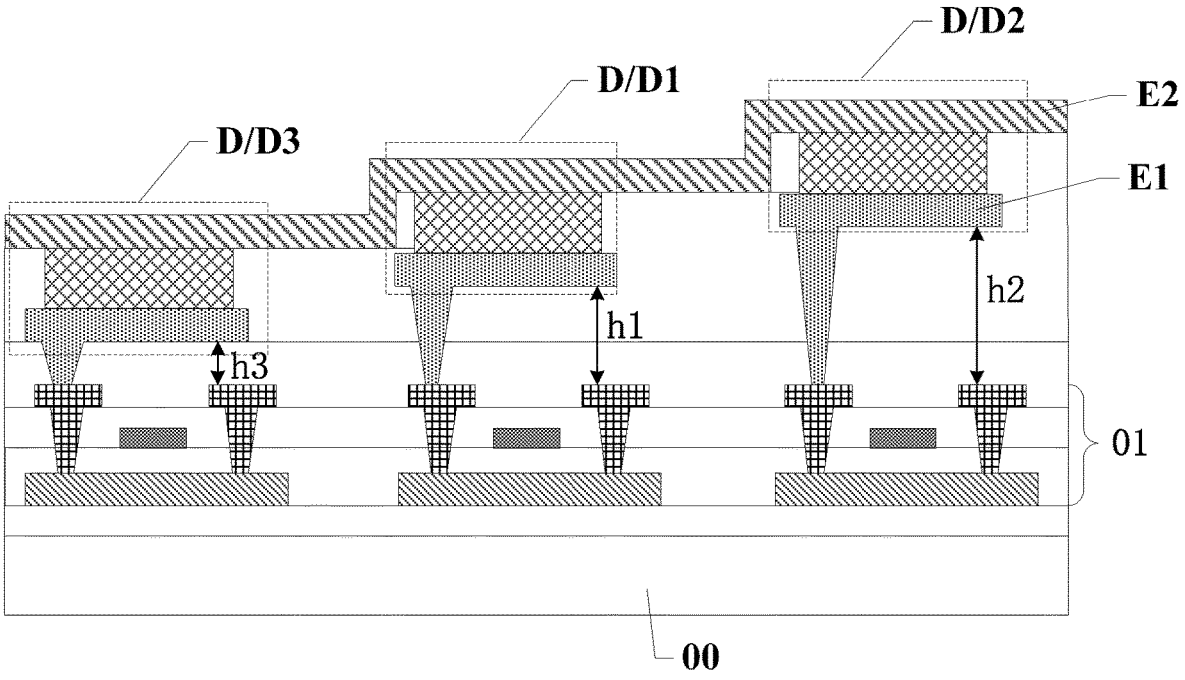
FIG. 11 illustrates another film structure diagram of a display panel consistent with various embodiments of the present disclosure.

FIG. 3 and FIG. 10 only illustrate a scheme in which a same light sensing detection circuit 30 includes two light sensing elements D located in two light sensing detection branches 10. In some other embodiments, a same light sensing detection circuit 30 may also include three or more light sensing elements D. Referring to FIG. 4 and FIG. 11, FIG. 11 illustrates another film structure diagram of a display panel consistent with various embodiments of the present disclosure. A third light sensing element D3 is introduced in the light sensing detection circuit 30. A distance h3 between the first electrode E1 and the array layer 01 corresponding to the third light sensing element D3 is smaller than the distance h1 between the first electrode E1 and the array layer 01 in the first light sensing element D1, so that the capacitance of the storage capacitor C in the light sensing detection branch 10 where the third light sensing element D3 is located is maximized, thereby realizing a light sensing detection of the light sensing detection circuit 30 under greater ambient light intensity. That is, the light sensing detection circuit 30 has a wide detection range.

Figure 12:
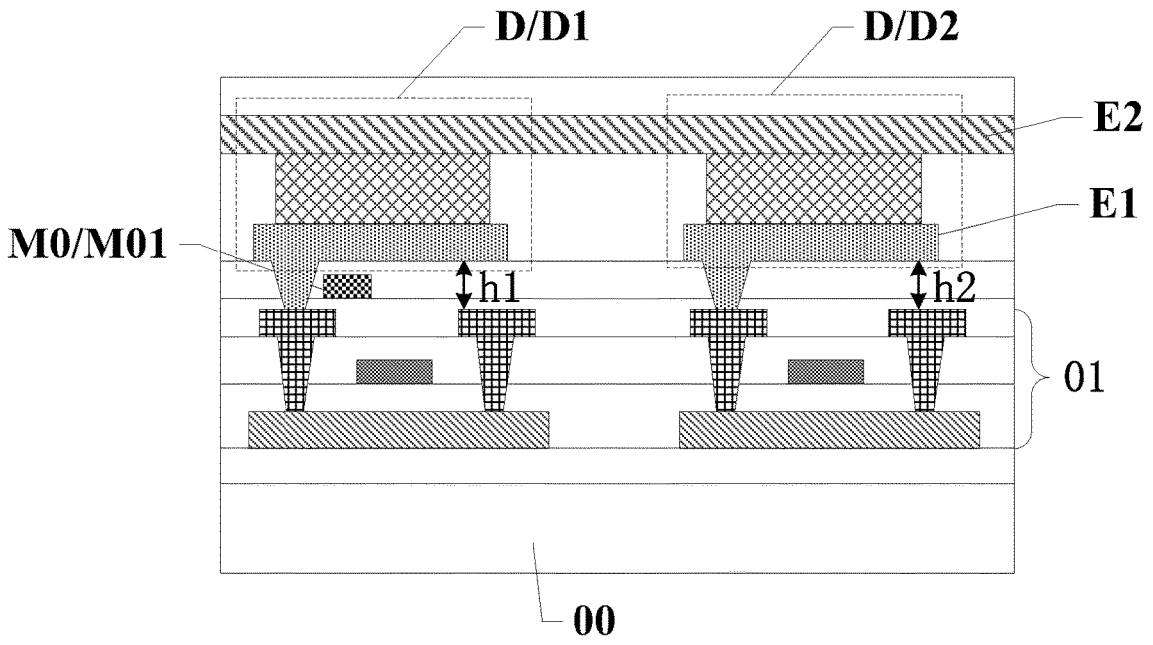
FIG. 12 illustrates another film structure diagram of a display panel consistent with various embodiments of the present disclosure.

FIG. 12 illustrates another film structure diagram of a display panel consistent with various embodiments of the present disclosure. In one optional embodiment, referring to FIG. 3 and FIG. 12, In a same light sensing detection circuit 30, along a direction perpendicular to the substrate 00, a first auxiliary metal layer M01 is provided at least between the first electrode E1 of the first light sensing element D1 and the array layer 01. The first electrode E1 of the first light sensing element D1 overlaps with the first auxiliary metal layer M01.

Specially, FIG. 12 shows a scheme that the first auxiliary metal layer M01 is provided between the first electrode E1 of the first light sensing element D1 and the array layer 01, and no auxiliary metal layer is provided between the first electrode E1 of the second light sensing element D2 and the array layer 01. When the first auxiliary metal layer M01 is introduced between the first electrode E1 of the first light sensing element D1 and the array layer 01, the first auxiliary metal layer M01 overlaps the first electrode E1 to form a capacitor. The capacitance of the first storage capacitor C1 in the first light sensing detection branch 11 where the first light-sensitive element D1 is located is increased, so that the capacitance of the first storage capacitor C1 is greater than the capacitance of the second storage capacitor C2 in the second light sensing detection branch 12. Therefore, the first light sensing detection branch 11 has a light sensitive detection function under a large ambient light intensity, and the second light-sensitive detection branch 12 has a high detection sensitivity.

Figure 13:
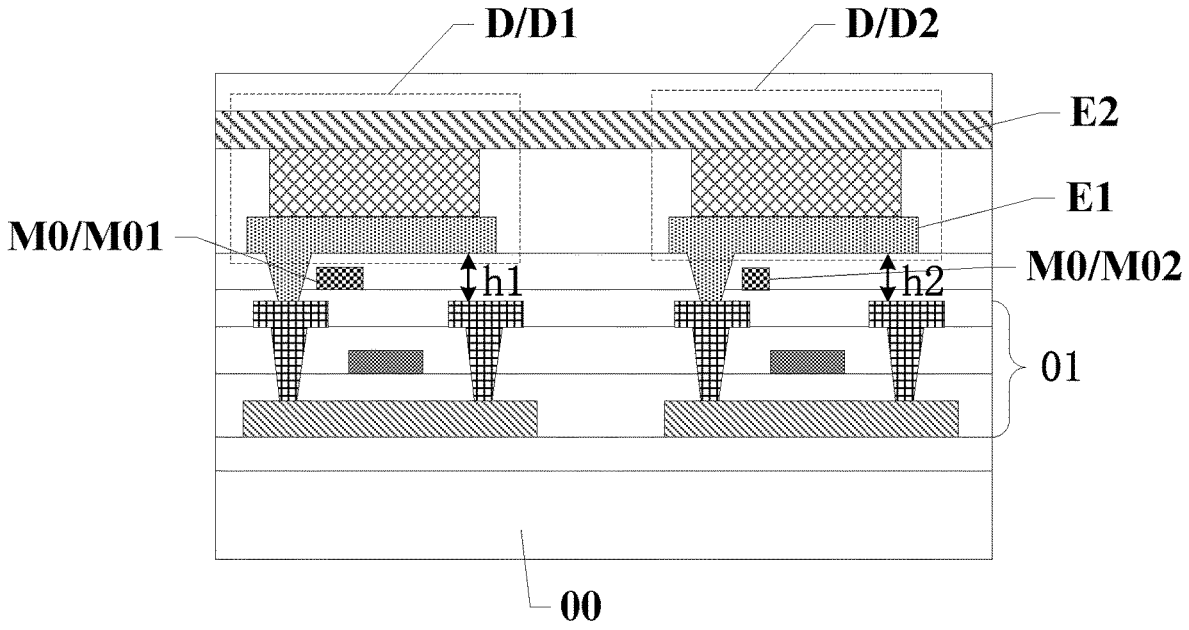
FIG. 13 illustrates another film structure diagram of a display panel consistent with various embodiments of the present disclosure.

FIG. 13 illustrates another film structure diagram of a display panel consistent with various embodiments of the present disclosure. In one optional embodiment, referring to FIG. 2, FIG. 3 and FIG. 12, In a same light sensing detection unit 20, along the direction perpendicular to the substrate 00, a second auxiliary metal layer M02 is provided between the first electrode E1 of the second light sensing element D2 and the array layer 01. The first electrode E1 of the second light sensing element of D2 overlaps the second auxiliary metal layer M02.

Along the direction perpendicular to the substrate 00, the overlapping area of the first electrode E1 of the first light sensing element D1 and the first auxiliary metal layer M01 is S1, an overlapping area of the first electrode E1 of the second light sensing element D2 and the second auxiliary metal layer M02 is S2, and S1>S2.

Specifically, FIG. 13 shows that a first auxiliary metal layer M01 is provided between the first electrode E1 of the first light sensing element D1 and the array layer 01, and at a same time, a second auxiliary metal layer M02 is provided between the first electrode E1 of the second light sensing element D2 and the array layer 01. The overlapping area S1 of the first auxiliary metal layer M01 and the first electrode of the first light sensing element D1 is larger than the overlapping area S2 of the second auxiliary metal layer M02 and the first electrode of the second light sensing element D2. The larger the overlapping area, the larger the storage capacitor C. Therefore, the capacitance of the first storage capacitor C1 of the first light sensing detection branch 11 is set to be greater than the capacitance of the second storage capacitor C2 of the second light sensing detection branch 12, so that the first light sensing detection branch 11 It has a light sensing detection function under a large ambient light intensity, and the second light sensing detection branch 12 has a high detection sensitivity.

Optionally, when the first auxiliary metal layer M01 and the second auxiliary metal layer M02 are introduced at a same time, the first auxiliary metal layer M01 and the second auxiliary metal layer M02 are arranged in a same layer to simplify a manufacturing process of the display panel.

Figure 14:
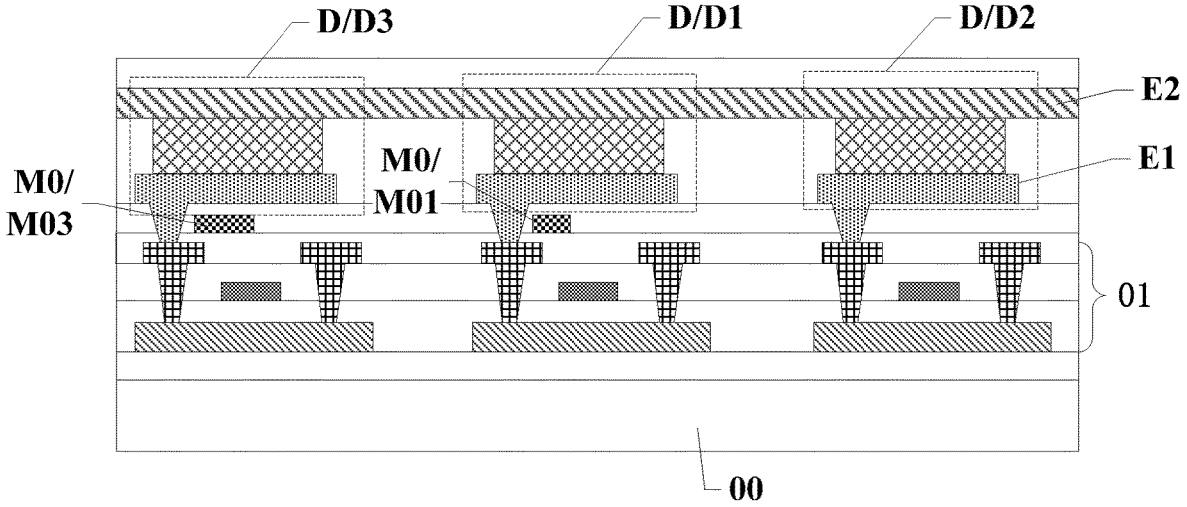
FIG. 14 illustrates another film structure diagram of a display panel consistent with various embodiments of the present disclosure.

FIG. 3 and FIG. 13 only show a scheme for a same light-sensitive detection circuit 30 including two light-sensitive elements D. To expand a detection range of the light sensing detection circuit 30, three or more light sensing elements D can be provided in the light sensing detection circuit 30. For example, referring to FIG. 4 and FIG. 14, FIG. 14 illustrates another film structure diagram of a display panel consistent with various embodiments of the present disclosure. In a same light sensing detection circuit 30, in addition to the first light sensing element D1 and the second light sensing element D2, a third light sensing element D3 is also provided. At a same time, a third auxiliary metal layer M03 is introduced between the first electrode of the third light sensing element D3 and the array layer 01, a first auxiliary metal layer M01 is introduced between the first electrode of the first light sensing element D1 and No auxiliary metal layer is introduced between the first electrode of the second photosensitive element D2 and the array layer 01. An overlapping area between the third auxiliary metal layer M03 and the first electrode of the third light sensing element D3 is larger than an overlapping area between the first auxiliary metal layer M01 and the first electrode of the first light sensing element D1, so that the capacitance of the storage capacitor C in the light sensing detection branch 10 corresponding to the three light sensing elements D3 is largest, thereby further increasing a detection range of the light sensing detection circuit 30.

Referring to FIG. 14, when the third auxiliary metal layer M03 and the first auxiliary metal layer M01 are introduced at a same time, the third auxiliary metal layer M03 and the first auxiliary metal layer M01 can be arranged in a same layer to simplify a manufacturing process of the display panel.

When three light sensing detection branches 10 are provided in a same light sensing detection circuit 30, to distinguish capacitances of the storage capacitors C in the three light sensing detection branches 10, a scheme shown in FIG. 14 can be adopted. Only the third auxiliary metal layer M03 corresponding to the third light sensing element D3 and the first auxiliary metal layer M01 corresponding to the first light sensing element D1 are introduced, the second auxiliary metal layer M02 corresponding to the second light sensing element D2 is not introduced, which is beneficial to reduce the capacitance of the second storage capacitor C2 in the second light sensing detection branch 12 where the second light sensing element D2 is located, and further improve a sensitivity of the second light sensing detection branch 12. In some other embodiments, in addition to introducing the first auxiliary metal layer M01 and the third auxiliary metal layer M03, a second auxiliary metal layer corresponding to the second light sensing element D2 can also be introduced. If it is ensured that different light sensing detection branches 10 in a same light sensing detection circuit 30 have storage capacitors with different capacitances, a light sensing detection function under different ambient light intensities can be realized.

In one optional embodiment, referring to FIG. 12 and FIG. 13, In a same light sensing detection unit 20, the distance between the first electrode E1 of the first light sensing element D1 and the array layer 01 is h1, the distance between the first electrode E1 of the second light sensing element D2 and the array layer 01 is h2, and h1=h2.

Specially, when a scheme of introducing an auxiliary metal layer M0 between first electrodes of at least part of the light sensing elements D and the array layer 01 is used to distinguish capacitances of the storage capacitors C of different light sensing detection branches 10 in the same light sensing detection circuit 30, different light sensing elements D in a same light sensing detection circuit 30 can be set at a same height. For example, in one embodiment shown in FIG. 12 and FIG. 13, a distance between the first light sensing element D1 and the array layer 01 and a distance between the second light sensing element D2 and the array layer 01 are equal. The above film structure is beneficial to simplify a manufacturing process of the display panel and improve a production efficiency of the display panel.

Figure 15:
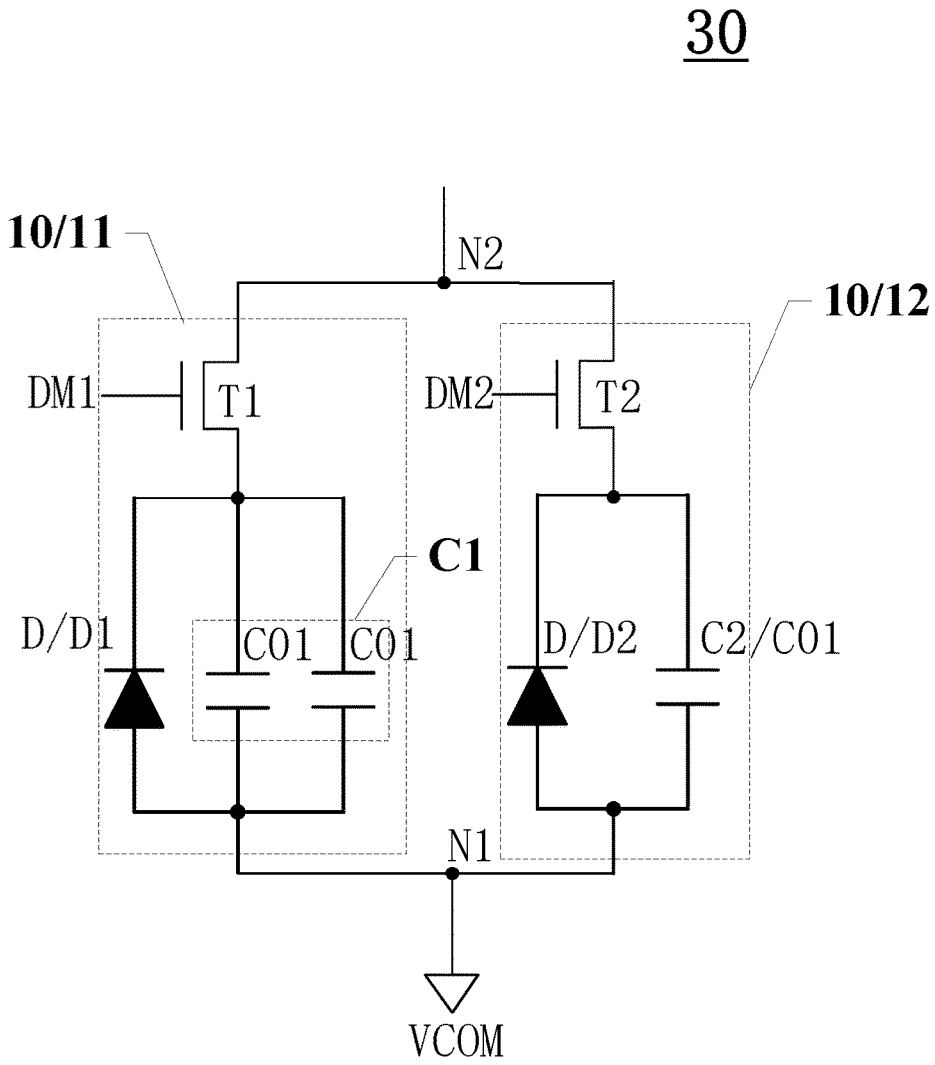
FIG. 15 illustrates another schematic diagram of a light sensing detection circuit in a display panel consistent with various embodiments of the present disclosure.

One embodiment shown in FIGS. 10 and 11 illustrates a scheme for distinguishing capacitances of different storage capacitors C in a same light sensing detection circuit 30 by changing a distance between first electrodes of the light sensing elements D and the array layer 01. One embodiment shown in FIGS. 12 to 14 illustrate a scheme for distinguishing capacitances of different storage capacitors C in a same light sensing detection circuit 30 by introducing the auxiliary metal layer M0 between first electrodes of part of the light sensing elements D and the array layer 01. In addition to adopting the above two schemes, other schemes can also be used to distinguish capacitances of the storage capacitor C. Referring to FIG. 15, FIG. 15 illustrates another schematic diagram of a light sensing detection circuit 30 in a display panel consistent with various embodiments of the present disclosure. In one optional embodiment, the first storage capacitor C1 includes m sub-capacitors C01, the second storage capacitor C2 includes n sub-capacitors C01, m>n, m sub-capacitors C01 in the first storage capacitor C1 are connected in parallel, and m and n are both positive integers.

Specially, referring to FIG. 15, taking m=2 and n=1 as an example, the first storage capacitor C1 includes two sub-capacitors C01 connected in parallel, and the second storage capacitor C2 includes one sub-capacitor C01. In the first storage capacitor C1, when the two sub-capacitors C01 are connected in parallel, a capacitance of the parallel capacitor is equivalent to the capacitance of the first storage capacitor C1. When two sub-capacitors C01 are connected in series, a capacitance after the series connection is equal to a sum of capacitances of the two sub-capacitors C01, so that the capacitance of the first storage capacitor C1 is greater than the capacitance of the second storage capacitor C2. Therefore, the parallel connection of the sub-capacitor C01 can also distinguish capacitance of different storage capacitors C. Under a strong ambient light intensity, a storage capacitor C with a larger capacitance ensures a detection range requirement of the light sensing circuit 30. As a sensitivity requirement and a detection range requirement of the light sensing detection circuit 30 are considered, the light sensing detection circuit 30 have a wide application range, which is conducive to improving a user experience.

FIG. 15 only shows a scheme in which the first storage capacitor C1 is composed of two sub-capacitors C01 connected in parallel, and the second storage capacitor C2 includes only one sub-capacitor C01. When the second storage capacitor C2 includes only one sub-capacitor C01, it is beneficial to reduce the capacitance of the second storage capacitor C2 and improve the sensitivity of the light sensing detection circuit 30 where the second storage capacitor C2 is located. In some other embodiments, number of sub-capacitors C01 included in each storage capacitor C can also be flexibly set according to actual conditions, and number of light sensing detection branches 10 included in a same light sensing detection circuit 30 can also be flexibly set according to actual conditions. For example, when a same light sensing detection circuit 30 includes three light sensing detection branches 10, among the three light sensing detection branches 10, number of sub-capacitors C01 included in different light sensing detection branches 10 can respectively be one, two, or three. In a light sensing detection branch including two sub-capacitors C01, two sub-capacitors C01 are connected in parallel. In light sensing detection branch including three sub-capacitors C01, three sub-capacitors C01 are connected in parallel, thereby realizing a scheme in which three light sensing detection branches 10 correspond to three storage capacitors C with different capacitances.

In one optional embodiment, referring to FIG. 15, capacitances of the sub-capacitors C01 are equal, that is, a capacitances of the sub-capacitor C01 included in each light sensing detection branch 10 is equal. When forming each sub-capacitor C01 in the display panel, it is sufficient to use a uniform specification and a uniform size to manufacture a related film structure, which is beneficial to simplify a manufacturing process of the display panel and improve a production efficiency of the display panel.

In one optional embodiment, referring to FIG. 15, number of sub-capacitors C01 included in the second light sensing detection branch 12 is n, and n=1. Or, if n>1, then sub-capacitors C01 in the second storage capacitor C2 are connected in series.

Specifically, when n=1, it means that number of sub-capacitors C01 included in the second light sensing detection branch 12 is 1, which not only helps to simplify a manufacturing process of the second storage capacitor C2 in the second light sensing detection branch 12, but also helps to improve the sensitivity of the second light sensing detection branch 12.

Figure 16:
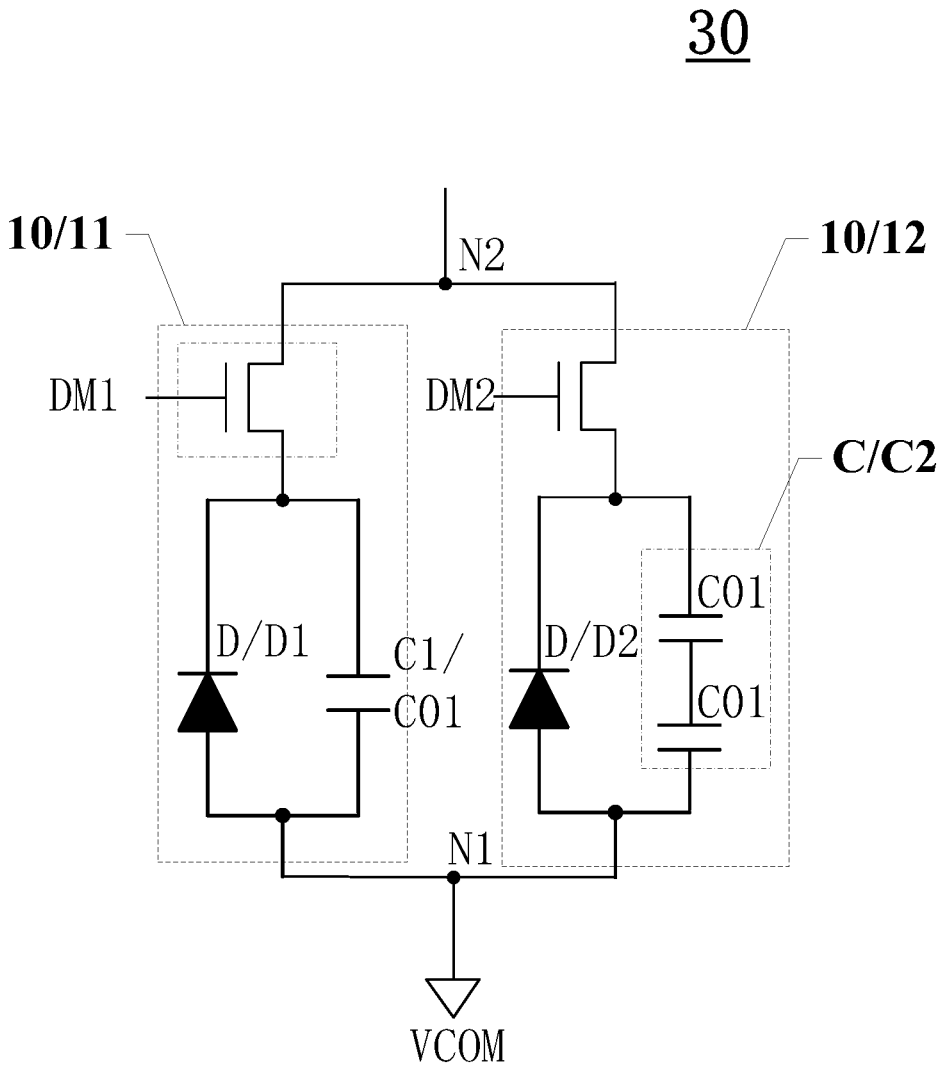
FIG. 16 illustrates another schematic diagram of a light sensing detection circuit in a display panel consistent with various embodiments of the present disclosure.

In some other embodiments, number of sub-capacitors C01 included in the second light sensing detection branch 12 may also be greater than 1. For example, referring to FIG. 16, FIG. 16 illustrates another schematic diagram of a light sensing detection circuit 30 in a display panel consistent with various embodiments of the present disclosure. In one embodiment, the second light sensing detection branch 12 including two sub-capacitors C01 connected in series as is taken as an example. In some other embodiments, number of the serially connected sub-capacitors C01 included in the second light sensing detection branch 12 may also be 3 or more, which is not specifically limited herein. When the sub-capacitors C01 are connected in series, a capacitance after the series connection will be smaller than a capacitance of any sub-capacitor C01. Therefore, the capacitance of the second storage capacitor C2 is reduced by connecting the sub-capacitors C01 in series, which helps realize a differentiated design of the storage capacitors C corresponding to different light sensing detection branches 10 in a same light sensing detection circuit 30. In addition, a detection sensitivity of the second light sensing detection branch 12 can be effectively improved.

When the second storage capacitor C2 is formed by connecting at least two sub-capacitors C01 in series, the first storage capacitor C1 may include only one sub-capacitor C01, or may be formed by using two or more sub-capacitors C01 in parallel so as to realize a differentiated design of the storage capacitors C in different light sensing detection branches 10.

In one optional embodiment, referring to FIG. 4, number of light sensing detection branches 10 included in the same light sensing detection circuit 30 is N, and N≥3. In a same light sensing detection circuit 30, capacitances of the storage capacitors C included in different light sensing detection branches 10 include a progressively increasing tendency.

Specially, FIG. 4 shows a scheme in which the same light sensing detection circuit 30 includes three light sensing detection branches 10. The first light sensing detection branch 11 corresponds to the first storage capacitor C1, the second light sensing detection branch 12 corresponds to the second storage capacitor C2, and the third light sensing detection branch 13 corresponds to the third storage capacitor C3. The capacitance of the second storage capacitor C2 is smaller than the capacitance of the first storage capacitor C1, and the capacitance of the first storage capacitor C1 is smaller than the capacitance of the third storage capacitor C3. The capacitances of the second storage capacitor C2, the first storage capacitor C1, and the third storage capacitor C3 include a progressively increasing tendency. Therefore, the light sensing detection branches 10 corresponding to the storage capacitors C with different capacitances can perform light sensing detections under different ambient light intensities, to meet different detection requirements for different ambient light intensities, which is beneficial to expand a detection range of the light sensing detection circuit 30.

In one optional embodiment, capacitances of the storage capacitors C included in the different light sensing detection branches 10 change by an arithmetic change (e.g., involving an equal difference) or a higher-order arithmetic change. Specifically, when the capacitances of the storage capacitors C included in the different light sensing detection branches 10 change by an arithmetic change or a higher-order arithmetic change, the capacitances of the storage capacitors C corresponding to the different light sensing detection branches 10 include a progressively increasing tendency, and capacitance of different storage capacitors C has a rule to follow at a same time. Light intensities of different light sensing detection branches 10 in corresponding detection environments have a certain difference, to better meet detection requirements under different light intensities.

In one optional embodiment, the display panel 100 also includes a light intensity detector electrically connected to the light sensing detection unit 20 for detecting an ambient light intensity. Specially, when a light intensity detector is set up in the display panel, before light sensing detection, the light intensity detector can be used to detect the ambient light intensity. A corresponding light sensing detection branch can be selected according to the detected ambient light intensity. Taking FIG. 2 as an example, when the ambient light intensity is weak, the second light sensing branch 12 can be selected for light sensing detection. When the ambient light intensity is strong, the first light sensing detection branch 11 can be selected for light sensing detection. A manner of determining a light sensing detection branch 10 that needs to be turned on according to different ambient light intensities is more targeted and makes a process of light sensing detection more flexible at a same time.

Based on a same inventive concept, the present disclosure also provides a light sensing detection method for the display panel 100. Referring to FIG. 2 and FIG. 3, the display panel 100 includes a plurality of light sensing detection units 20. A light sensing detection unit of the plurality of light sensing detection units 20 includes a light sensing detection circuit 30. The light sensing detection circuit 30 corresponding to a same light sensing detection unit 20 includes N light sensing detection branches 10 connected in parallel, a light sensing detection branch of the N light sensing detection branches 10 includes a storage capacitor C, and N≥2. The N light sensing detection branches 10 include a first light sensing detection branch 11 and a second light sensing detection branch 12. The storage capacitor C includes a first storage capacitor C1 located in the first light sensing detection branch 11 and a second storage capacitor C2 located in the second light sensing detection branch 12. A capacitance of the first storage capacitor C1 is greater than a capacitance of the second storage capacitor C2.

Figure 17:
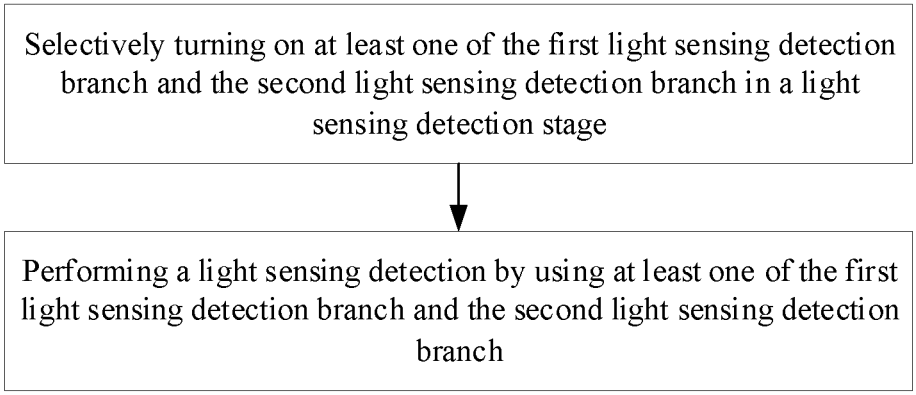
FIG. 17 illustrates a flow chart of light sensing detection method consistent with various embodiments of the present disclosure.

Referring to FIG. 17, the light sensing detection method includes: selectively turning on at least one of the first light sensing detection branch and the second light sensing detection branch in a light sensing detection stage and performing a light sensing detection by using at least one of the first light sensing detection branch and the second light sensing detection branch. FIG. 17 illustrates a flow chart of light sensing detection method consistent with various embodiments of the present disclosure.

Specially, since the light sensing detection circuit 30 includes at least two light sensing detection branches 10 connected in parallel, in a light sensing detection stage, at least one light sensing detection branch 10 can be selectively turned on for light sensing detection according to different ambient light intensities. Under a weak ambient light intensity, only the light sensing detection branch 10 corresponding to a storage capacitor C with a smaller capacitance can be turned on. For example, the second light sensing detection branch 12 where the second storage capacitor C2 is located is turned on, and the second light sensing detection branch 12 is used for light sensing detection. The light sensing detection unit 20 has a better sensitivity. Under a strong ambient light intensity, the light sensing detection branch 10 where a storage capacitor C with a larger capacitance is located can be turned on. For example, the first light sensing detection branch 11 where the first storage capacitor C1 is located is turned on. The first light sensing detection branch 11 is used for light sensing detection, to realize a light sensing detection function under a strong ambient light intensity. Therefore, under the condition of a weak ambient light intensity, the storage capacitor C with a smaller capacitance ensures a high sensitivity requirement of the light sensing detection unit 20. Under the condition of strong ambient light intensity, the storage capacitor C with a larger capacitance ensures a detection range requirement of the light sensing detection unit 20. As both the sensitivity requirement and the detection range requirement of the light sensing detection circuit 30 are considered, the light sensing detection circuit 30 has a wide application range and is more conducive to improving a user experience.

In one optional embodiment, the display panel further includes a light intensity detector, the light intensity detector is used to detect an ambient light intensity. A light sensing detection branch that needs to be turned on is selected according to the ambient light intensity.

Specifically, before a light sensing detection, the light intensity detector is used to detect the ambient light intensity. According to the actual ambient light intensity, a light sensing detection branch that needs to be turned on is selected. That is, which light sensing detection branch or branches are turned on is determined by the ambient light intensity detected by the light-intensity detector. According to the detected ambient light intensity, a corresponding light sensing detection branch is selectively turned on. For example, when the ambient light intensity is weak, a light sensing detection branch with a small capacitance of a storage capacitor can be selectively turned on to perform a light sensing detection. When the ambient light intensity is strong, a light sensing detection branch with a large capacitance of a storage capacitor can be selectively turned on to perform a light sensing detection. A manner of determining a light sensing detection branch 10 that needs to be turned on according to different ambient light intensities is more targeted and makes a process of light sensing detection more flexible at a same time.

In one optional embodiment, referring to FIG. 3 and FIG. 4, before a light sensing detection stage, the second light sensing detection branch 12 is turned on for light sensing detection.

Whether an output value of the light sensing detection circuit 30 is saturated is determined. If the output value of the light sensing detection circuit 30 is not saturated, the second light sensing detection branch 12 is continually used for detection. If the output value of the light sensing detection circuit 30 is saturated, the first light sensing detection branch 11 is turned on for light sensing detection, or the first light sensing detection branch 11 and the second light sensing detection branch 12 are turned on at a same time, and the first light sensing detection branch 11 and the second light sensing detection branch 12 are used for light sensing detection.

Specially, the above embodiment provides another scheme for selecting a conduction light sensing branch 10. In any ambient light intensity, the second light sensing detection branch 12 with a highest sensitivity and a smallest storage capacitance is turned on first. According to the output value of the light sensing detection circuit 30 to determine whether it is necessary to switch other light sensing detection branches 10. Specifically, whether the output value of the light sensing detection circuit 30 is saturated is determined. If the output value of the light sensing detection circuit 30 is not saturated, the second light sensing detection branch 12 is continually used for detection. If the output value of the light sensing detection circuit 30 is saturated, the first light sensing detection branch 11 with a large capacitance is selected for light sensing detection. Or the first light sensing detection branch 11 and the second light sensing detection branch 12 are turned on for detection at a same time. When the first light sensing detection branch 11 and the second light sensing detection branch 12 are turned on at a same time, the sensitivity of the light sensing detection circuit 30 is between a sensitivity when only the first light sensing detection branch 11 is turned on and a sensitivity when only the second light sensing detection branch 12 is turned on. The ambient light intensity that can be sensed is also between an ambient light intensity when only the first light sensing detection branch 11 is turned on, and an ambient light intensity when only the second light sensing detection branch 12 is turned on, thereby realizing an automatic switching of different light sensing detection branches 10 under different ambient light intensities and a light sensing detection function under different ambient light intensities.

Figure 18:
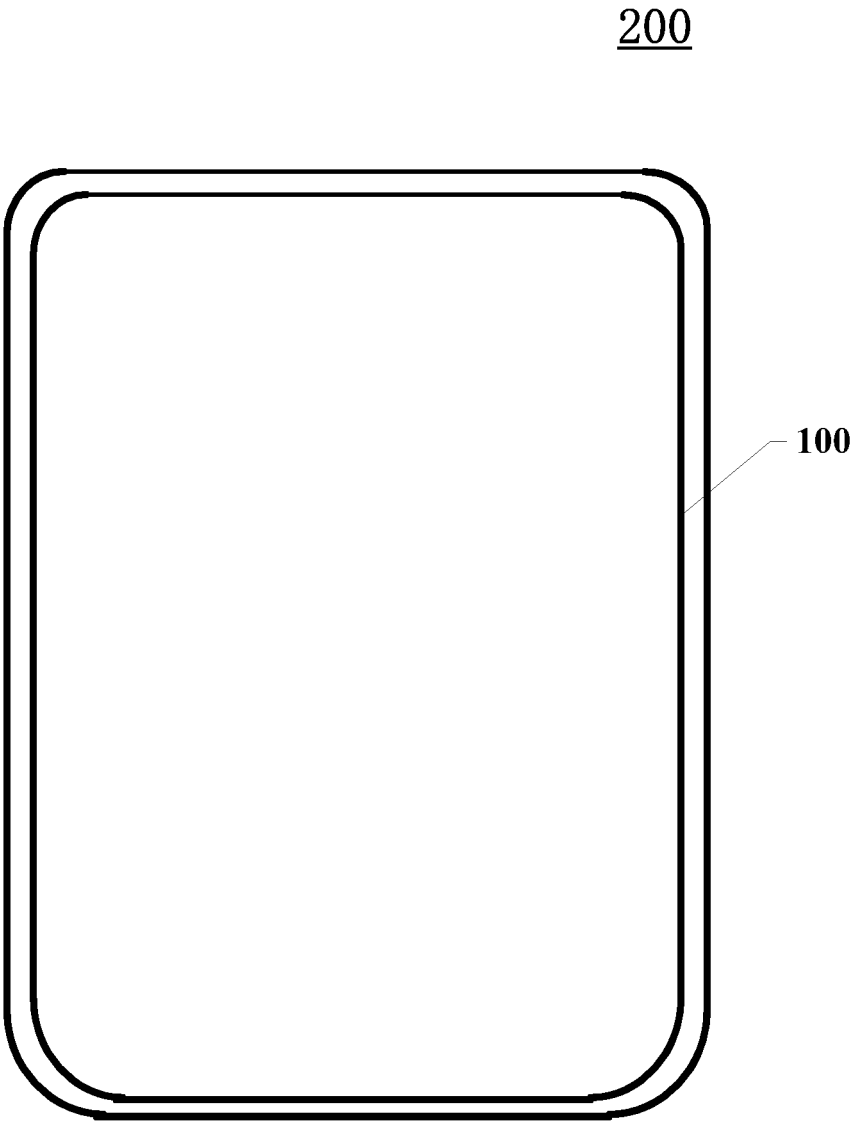
FIG. 18 illustrates a top view of a display device consistent with various embodiments of the present disclosure.

Based on a same inventive concept, the present disclosure also provides a display device 200. FIG. 18 illustrates a top view of the display device 200 consistent with various embodiments of the present disclosure. The display device includes the display panel 100 provided by any of the above embodiments. In the display device 200, since a same light sensing detection circuit is provided with at least two light sensing detection branches connected in parallel, capacitances of storage capacitors of the two light sensing detection branches are different. A sensitivity of a light sensing detection branch with a small storage capacitance is higher, which is suitable for light sensing detection in a weak light intensity. A light sensing detection branch with a large storage capacitance has a lower sensitivity and is suitable for light sensing detection in a strong light intensity, thereby considering needs of a high sensitivity and a wide detection range.

For the embodiment of the display device 200, reference can be made to the embodiments of the above display panel 100. A device provided by the present disclosure can be any product or component with a display function, such as a mobile phone, a tablet computer, a TV, a monitor, a notebook computer, a digital photo frame, or a navigator. The display device provided by the present disclosure can be a liquid crystal display device, an organic light-emitting display device, a Mini-LED display device or a Micro-LED display device, etc.

As disclosed, the display panel, the light sensing detection method thereof and the display device provided by the present disclosure have the following beneficial effects.

In the display panel, the light sensing detection method thereof and the display device, the light sensing detection branch corresponding to the same light sensing detection unit includes at least two light sensing detection branches connected in parallel, and different light sensing detection branches correspond to different storage capacitors. The smaller a capacitance of a storage capacitor, the higher a sensitivity of a light sensing detection unit. The larger a capacitance of the storage capacitor, the larger a dynamic detection range. Under a weak ambient light intensity, only the light sensing detection branch corresponding to the storage capacitor with a small capacitance, such as the second light sensing detection branch where the second storage capacitor is located, so that the light sensing detection unit has a better sensitivity. Under a strong ambient light intensity, the light sensing detection branch where the storage capacitor is located with a larger capacitance, such as the first light sensing detection branch where the first storage capacitor is located, can be turned on, to realize a light sensing detection function under a strong ambient light intensity. Therefore, under the condition of a weak ambient light, the high sensitivity requirement of the light-sensitive detection unit is guaranteed; under the condition of strong ambient light, the detection range requirement of the light sensing detection unit is guaranteed. As both the sensitivity requirement and the detection range requirement of the light sensing detection unit are considered, the light sensing detection unit has a wide application range and is more conducive to improving a user experience.

Although some specific embodiments of the present disclosure have been described in detail through examples, those skilled in the art should understand that the above examples are only for illustration and not for limiting a scope of the present disclosure. Those skilled in the art should understand that the above embodiments can be modified without departing from the scope and spirit of the present disclosure. The scope of the disclosure is defined by the appended claims.

What is claimed is:

1. A display panel, comprising a plurality of light sensing detection units, wherein:

a light sensing detection unit of the plurality of light sensing detection units includes a light sensing detection circuit;

the light sensing detection circuit corresponding to a same light sensing detection unit includes N light sensing detection branches connected in parallel, a light sensing detection branch of the N light sensing detection branches includes a storage capacitor, N>2;

the N light sensing detection branches include a first light sensing detection branch and a second light sensing detection branch, the storage capacitor includes a first storage capacitor located in the first light sensing detection branch and a second storage capacitor located in the second light sensing detection branch, and a capacitance of the first storage capacitor is greater than a capacitance of the second storage capacitor; and the display panel further comprises a substrate, an array layer, and light sensing elements, wherein:

along a direction perpendicular to the substrate, the light sensing elements are located on a side of the array layer away from the substrate, a light sensing element of the light sensing elements includes a first electrode and a second electrode provided opposite to each other in the direction perpendicular to the substrate, the first electrode is located on a side of the second electrode facing the substrate; and the light sensing elements include a first light sensing element located in the first light sensing detection branch and a second light sensing element located in the second light sensing detection branch.

2. The display panel according to claim 1, wherein in a same light sensing detection circuit, a distance between a first electrode of the first light sensing element and the array layer is h1, a distance between a first electrode of the second light sensing element and the array layer is h2, and h1<h2.

3. The display panel according to claim 1, wherein in a same light sensing detection circuit, along the direction perpendicular to the substrate, a first auxiliary metal layer is provided at least between a first electrode of the first light sensing element and the array layer, and the first electrode of the first light sensing element overlaps the first auxiliary metal layer.

4. The display panel according to claim 3, wherein:

in a same light sensing detection circuit, along the direction perpendicular to the substrate, a second auxiliary metal layer is provided at least between a first electrode of the second light sensing element and the array layer, the first electrode of the second light sensing element overlaps the second auxiliary metal layer; and along the direction perpendicular to the substrate, an overlapping area of the first electrode of the first light sensing element and the first auxiliary metal layer is S1, an overlapping area of the first electrode of the second light sensing element and the second auxiliary metal layer is S2, and S1>S2.

5. The display panel according to claim 4, wherein in a same light sensing detection unit, a distance between the first electrode of the first light sensing element and the array layer is h1, a distance between the first electrode of the second light sensing element and the array layer is h2, and h1=h2.

6. The display panel according to claim 4, further comprising a light intensity detector electrically connected to a light sensing detection unit and used for detecting an ambient light intensity.

7. A light sensing detection method of a display panel, wherein:

the display panel includes a plurality of light sensing detection units, a light sensing detection unit of the plurality of light sensing detection units includes a light sensing detection circuit;

the light sensing detection circuit corresponding to a same light sensing detection unit includes N light sensing detection branches connected in parallel, a light sensing detection branch of the N light sensing detection branches includes a storage capacitor, N≥2;

the N light sensing detection branches include a first light sensing detection branch and a second light sensing detection branch, the storage capacitor includes a first storage capacitor located in the first light sensing detection branch and a second storage capacitor located in the second light sensing detection branch, and a capacitance of the first storage capacitor is greater than a capacitance of the second storage capacitor; and the light sensing detection method including:

selectively turning on at least one of the first light sensing detection branch and the second light sensing detection branch in a light sensing detection stage and performing a light sensing detection by using at least one of the first light sensing detection branch and the second light sensing detection branch.

8. The light sensing detection method according to claim 7, wherein the display panel further includes a light intensity detector used for detecting an ambient light intensity, and a light sensing detection branch is selected to be turned on according to the ambient light intensity.

9. The light sensing detection method according to claim 7, further comprising:

turning on the second light sensing detection branch first and performing a light sensing detection by the second light sensing detection branch before a light sensing detection stage; and determining whether an output value of the light sensing detection circuit is saturated, if the output value is not saturated, continually using the second light sensing detection branch for detection, if the output value is saturated, turning on the first light sensing detection branch, and performing a light sensing detection by using the first light sensing detection branch, or turning on the first light sensing detection branch and the second light sensing detection branch at a same time, and performing a light sensing detection by using the first light sensing detection branch and the second light sensing detection branch.

10. A display panel, comprising a plurality of light sensing detection units, wherein:

a light sensing detection unit of the plurality of light sensing detection units includes a light sensing detection circuit;

the light sensing detection circuit corresponding to a same light sensing detection unit includes N light sensing detection branches connected in parallel, a light sensing detection branch of the N light sensing detection branches includes a storage capacitor, N≥2; and the N light sensing detection branches include a first light sensing detection branch and a second light sensing detection branch, the storage capacitor includes a first storage capacitor located in the first light sensing detection branch and a second storage capacitor located in the second light sensing detection branch, and a capacitance of the first storage capacitor is greater than a capacitance of the second storage capacitor.

11. The display panel according to claim 10, wherein the light sensing detection circuit further includes a first node and a second node, in a same light sensing detection circuit, each light sensing detection branch is connected in parallel between the first node and the second node, and the first node receives a first fixed voltage signal.

12. The display panel according to claim 11, wherein:

the light sensing detection branch further includes a switching circuit and a light sensing element, the switching circuit includes a control terminal, a first electrode, and a second electrode;

in a same light sensing detection branch, the light sensing element and the storage capacitor are connected in parallel between the first node and the first electrode of the switching circuit, the second electrode of the switching circuit is connected to the second node; and in a same light sensing detection circuit, control terminals of switching circuits of different light sensing detection branches are connected to different switching signal terminals.

13. The display panel according to claim 12, wherein the switching circuit includes a switch transistor, the switch transistor includes a first switch transistor located in the first light sensing detection branch and a second switch transistor located in the second light sensing detection branch, and a width-to-length ratio of the first switch transistor is greater than a width-to-length ratio of the second switch transistor.

14. The display panel according to claim 11, wherein:

the light sensing detection circuit further includes a light sensing detection main circuit connected to the second node; and the light sensing detection main circuit includes a first transistor, a second transistor and a third transistor, a gate of the first transistor is connected to a first control signal terminal, a first electrode of the first transistor and a gate of the second transistor are connected to the second node, a second electrode of the first transistor is connected to a first electrode of the second transistor and receives a second fixed voltage signal, a second electrode of the second transistor is connected to a first electrode of the third transistor, a second electrode of the third transistor is used as an output terminal of the light sensing detection circuit, and a gate of the third transistor is connected to a second control signal terminal.

15. The display panel according to claim 11, wherein:

the light sensing detection circuit further includes a third node;

the light sensing detection branches further include a reset transistor, a drive transistor and a light sensing element respectively, in a same light sensing detection branch, the light sensing element and the storage capacitor are connected in parallel between the first node and a first electrode of the reset transistor;

the first electrode of the reset transistor is also electrically connected to a gate of the drive transistor, a first electrode of the drive transistor is connected to the second node, a second electrode of the drive transistor is connected to the third node, the second node receives a second fixed voltage signal; and in a same light sensing detection branch, a gate of the reset transistor in each light sensing detection branch is connected to a same first control signal terminal, a second electrode of the reset transistor in each light sensing detection branch is connected to a different reset signal terminal.

16. The display panel according to claim 15, wherein the light sensing detection circuit also includes a light sensing detection main circuit, the light sensing detection main circuit includes an output transistor, a gate of the output transistor is connected to a second control signal terminal, a first electrode of the output transistor is connected to the third node, and a second electrode of the output transistor is used as an output terminal of the light sensing detection circuit.

17. The display panel according to claim 10, wherein the first storage capacitor includes m sub-capacitors, the second storage capacitor includes n sub-capacitors, m>n, the m sub-capacitors in the first storage capacitor are connected in parallel, and m and n are both positive integers.

18. The display panel according to claim 17, wherein a capacitance of each sub-capacitor is equal.

19. The panel according to claim 17, wherein n=1, or when n>1, the n sub-capacitors in the second storage capacitor are connected in series.

20. The display panel according to claim 10, wherein N≥3, in a same light sensing detection circuit, capacitances of storage capacitors included in different light sensing detection branches include a progressively increasing tendency.

21. The display panel according to claim 20, wherein the capacitances of the storage capacitors included in the different light sensing detection branches change by an arithmetic change or a higher-order arithmetic change.

22. A display device, comprising the display panel according to claim 10.

* * * * *